US010655455B2

(12) United States Patent
Hopper et al.

(10) Patent No.: US 10,655,455 B2
(45) Date of Patent: May 19, 2020

(54) FLUID ANALYSIS MONITORING SYSTEM

(71) Applicant: Cameron International Corporation, Houston, TX (US)

(72) Inventors: Hans Paul Hopper, Aberdeen (GB); Emanuel Gottlieb, Upper St. Clair, PA (US); Omar M. Kabir, Waller, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 504 days.

(21) Appl. No.: 15/270,261

(22) Filed: Sep. 20, 2016

(65) Prior Publication Data

US 2018/0080317 A1 Mar. 22, 2018

(51) Int. Cl.

| | |
|---|---|
| ***E21B 47/10*** | (2012.01) |
| ***E21B 21/01*** | (2006.01) |
| ***E21B 21/08*** | (2006.01) |

(52) U.S. Cl.

CPC ..... *E21B 47/10* (2013.01); *E21B 21/01* (2013.01); *E21B 21/08* (2013.01)

(58) Field of Classification Search

CPC ..... E21B 21/01; E21B 21/08; E21B 47/10
See application file for complete search history.

(56) References Cited

U.S. PATENT DOCUMENTS 1,643,155 A * 9/1927 Eisenschitz ..... G01N 27/16 422/95
2,279,254 A 4/1942 Irwin
2,925,251 A * 2/1960 Arps ..... E21B 47/12 116/137 R
3,282,113 A * 11/1966 Sachnik ..... F16L 55/00 73/863.02
3,429,186 A * 2/1969 Price ..... G01N 1/22 73/863.61
3,681,997 A * 8/1972 Allen ..... G01N 1/2035 73/863.61
4,235,099 A 11/1980 Ishizaka
4,307,620 A * 12/1981 Jiskoot ..... G01N 1/2035 73/863.61

(Continued)

OTHER PUBLICATIONS http://www2.emersonprocess.com/enUS/news/pr/Pages/1505RoxarWetgasMeter.aspx, Emerson launches subsea wet gas meter to reduce risk and strengthen production optimization strategies, News Release, May 5, 2015, Emerson, Stavanger, Norway.

(Continued)

*Primary Examiner* — John Fitzgerald
(74) *Attorney, Agent, or Firm* — Helene Raybaud

(57) ABSTRACT

A system includes a channel having a first end configured to be fluidly coupled to a first portion of a conduit of a drilling system or a production system to enable fluid to flow from the conduit into the channel and a second end configured to be fluidly coupled to a second portion of the conduit to enable return of the fluid from the channel into the conduit. The system also includes at least one sensor positioned along the channel and configured to generate a signal indicative of a characteristic of the fluid as the fluid flows through the channel. The system further includes a pump positioned along the channel and configured to adjust a flow rate of the fluid through the channel.

19 Claims, 13 Drawing Sheets

(56) References Cited

U.S. PATENT DOCUMENTS 4,402,910 A * 9/1983 Smith ..... E21B 49/005 422/83
4,522,068 A 6/1985 Smith
4,580,444 A 4/1986 Abts et al.
4,635,735 A * 1/1987 Crownover ..... E21B 21/067 175/42
4,646,844 A * 3/1987 Roche ..... E21B 21/001 166/379
4,892,383 A 1/1990 Kleiner et al.
5,000,052 A * 3/1991 Sipin ..... G01N 1/2202 73/863.03
5,006,845 A * 4/1991 Calcar ..... E21B 21/001 166/336
5,101,670 A * 4/1992 Steger ..... G01N 1/2035 73/863.03
5,572,320 A * 11/1996 Reintjes ..... G01N 15/0227 356/246
5,619,333 A * 4/1997 Staff ..... G01N 21/534 356/335
5,841,020 A * 11/1998 Guelich ..... G01F 1/363 73/19.12
6,640,900 B2 11/2003 Smith
6,746,606 B2 * 6/2004 Pfeil ..... F04B 49/20 137/10
7,578,350 B2 8/2009 Cooper et al.
7,650,950 B2 * 1/2010 Leuchtenberg ..... E21B 21/08 166/53
8,056,400 B2 * 11/2011 Reintjes ..... G01N 1/14 73/64.56
8,434,357 B2 * 5/2013 Hsu ..... E21B 47/102 73/152.24
8,495,913 B2 7/2013 Partington et al.
9,567,843 B2 * 2/2017 Saeed ..... E21B 21/08
9,804,011 B2 * 10/2017 Mesnard ..... G01F 25/0007
10,018,091 B2 * 7/2018 Hendrickson ..... F01N 3/208
2004/0045350 A1 * 3/2004 Jones ..... E21B 43/38 73/152.23
2010/0147528 A1 * 6/2010 Baugh ..... E21B 19/004 166/355
2010/0300557 A1 * 12/2010 Fei ..... G01N 29/024 137/551
2011/0042071 A1 * 2/2011 Hsu ..... E21B 47/102 166/250.01
2011/0259581 A1 * 10/2011 Bedouet ..... E21B 49/005 166/250.03
2012/0191380 A1 * 7/2012 Winter ..... G01D 4/006 702/45
2012/0274475 A1 * 11/2012 Milne ..... E21B 47/10 340/853.1
2013/0105169 A1 * 5/2013 Robichaux ..... E21B 7/12 166/358
2013/0319104 A1 * 12/2013 Schexnaider ..... E21B 49/005 73/152.42
2014/0119954 A1 * 5/2014 Schweitzer ..... A61M 5/142 417/63
2014/0208840 A1 * 7/2014 Bright ..... G01N 33/0006 73/152.19
2014/0277745 A1 * 9/2014 Keizer ..... G05D 11/138 700/265
2014/0311737 A1 * 10/2014 Bedouet ..... E21B 49/005 166/264
2015/0361742 A1 12/2015 Gottlieb et al.
2016/0091355 A1 * 3/2016 Mesnard ..... G01F 25/0007 73/197
2016/0124440 A1 * 5/2016 Takijiri ..... G05D 7/0635 137/455
2016/0176704 A1 * 6/2016 Cargill ..... H04R 19/005 257/419
2016/0215608 A1 7/2016 Jaffrey
2017/0184650 A1 * 6/2017 Chang ..... G01M 5/0091
2017/0284198 A1 * 10/2017 Pop ..... E21B 49/087
2017/0284199 A1 * 10/2017 Indo ..... E21B 49/10
2017/0328152 A1 11/2017 Jeffrey et al.
2017/0352930 A1 * 12/2017 Masias ..... F04B 43/12
2017/0370763 A1 * 12/2017 Brashear ..... G01F 1/86
2018/0002168 A1 * 1/2018 Cargill ..... B81C 1/00666
2018/0110913 A1 * 4/2018 Loderer ..... A61M 1/3626
2018/0128257 A1 * 5/2018 Robert ..... B60K 6/44
2018/0217101 A1 * 8/2018 Hopper ..... G01N 29/02
2018/0231496 A1 * 8/2018 Brennan ..... G01N 27/4165

OTHER PUBLICATIONS

Molz, Eric, et al., Ultrasonic Velocity and Attenuation Measurements in High Density Drilling Muds, SPWLA 39th Annual Logging Symposium, May 26-29, 1998, 19 pgs, Houston, TX, US.
Hayman, A. J., Ultrasonic Properties of Oil-Well Drilling Muds, 1989 Ultrasonics Symposium, pp. 327-332, IEEE, Clamart, France.

* cited by examiner

FLUID ANALYSIS MONITORING SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of a desired resource. Further, such systems generally include numerous fluid conduits to contain and/or to direct fluids, such as drilling mud, production fluid, or the like during drilling and extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
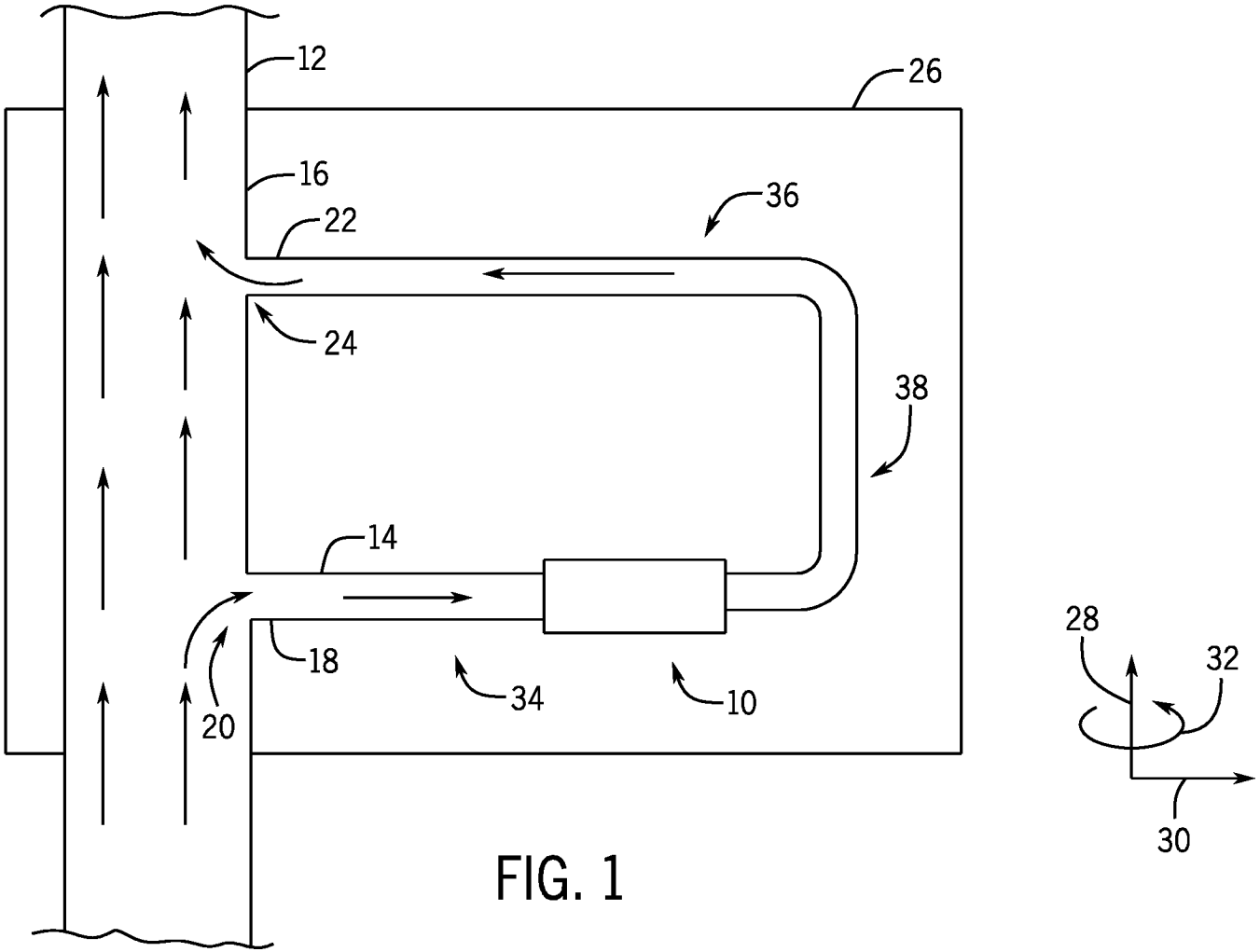
FIG. 1 is a schematic diagram of a fluid analysis monitoring system (FAMS) coupled to a fluid conduit, in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers'specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments relate generally to a fluid analysis monitoring system (FAMS) that may be used to monitor one or more characteristics of a fluid within a conduit (e.g., fluid conduit or passageway) of a drilling system and/or a production system. In certain embodiments, the FAMS may include a channel (e.g., fluid conduit or passageway), one or more sensors configured to monitor respective characteristics of the fluid, one or more valves, a flow control device, such as a pump, a filter, and/or a flush system, for example. In certain embodiments, a first end of the channel may be fluidly coupled to a first portion of the conduit to enable fluid flow from the conduit into the channel and a second end of the channel may be fluidly coupled to a second portion of the conduit to enable return of the fluid from the channel into the conduit. At least one valve may be positioned proximate to the first end of the channel and/or at least one valve may be positioned proximate to the second end of the channel to adjust fluid flow from the conduit and/or through the channel.

The channel may extend through or be coupled to the one or more sensors. Thus, as the fluid flows through the channel, the one or more sensors may monitor respective characteristics (e.g., parameters) of the fluid. In some embodiments, the one or more sensors may be configured to generate signals indicative of a pressure, a temperature, a conductivity, a capacitance, a dielectric constant, a chemical level (e.g., a carbon dioxide level or gas composition) an ultrasonic frequency, an ultrasonic velocity, attenuation of acoustic waves, absorption of light and/or energy, a density, a viscosity, a free gas content, an oil content, and/or a water content of the fluid, for example. In some embodiments, the pump may be used to facilitate fluid flow within the channel and/or to adjust a flow rate of the fluid through the channel, the filter may capture debris flowing through the channel, and/or the flush system may be used to provide a flush fluid to flush and/or clean the channel, filters, and/or other components of the FAMS. Thus, in operation, the FAMS may divert or extract fluid from the conduit into the channel, use one or more sensors to monitor respective characteristics of the fluid, and subsequently return the fluid to the conduit. It should be understood that the systems and methods disclosed herein may be adapted to monitor any of a variety of fluids, such as any type of produced fluids, extracted fluids, supplied fluids, injected fluids, mud, water, steam, oil, gases, or the like, in any type of drilling and/or production system. Furthermore, the systems and methods disclosed herein may be adapted for use with any of a variety of conduits within drilling and/or production systems, such as a riser, a choke line, a kill line, or any suitable pipeline or conduit that supports a fluid.

Some typical systems for monitoring characteristics of fluids within drilling and/or production systems may include sensors positioned directly within the conduit. However, such typical systems may be incapable of monitoring characteristics of the fluid within the conduit during certain drilling operations, such as when physical structures are positioned within the conduit (e.g., when a drill string is positioned within a riser, during casing installation, or the like). Furthermore, such typical systems may not accurately or reliably monitor characteristics of the fluid within the conduit due to uncontrolled, unknown, inappropriate, and/or varying flow rates (e.g., turbulent flow, stagnant, etc.) and/or because a distance across the conduit may be inappropriate (e.g., for transmitter and receiver pairs that exchange signals across the conduit). Advantageously, the FAMS may enable fluid monitoring regardless of obstructions or physical structures within the conduit. Furthermore, the FAMS may control of a flow rate of the fluid within the channel to enable each sensor to accurately and reliably monitor the respective characteristic and/or may provide an appropriate channel configuration for each sensor and/or an appropriate spacing between transmitter and receiver pairs, for example. The FAMS may also enable real-time monitoring and/or monitoring at generally remote or inaccessible locations, such as subsea locations, for example. Such a configuration may enable identification of changes to the fluid or undesirable characteristics of the fluid in real-time or more quickly (e.g., as compared to systems that monitor the fluid at surface locations or downstream locations), thereby improving efficiency and operation of the drilling and production system, for example.

With the foregoing in mind, FIG. 1 is a schematic diagram of a fluid analysis monitoring system (FAMS) 10 coupled to a conduit 12 (e.g. fluid conduit or passageway), in accordance with an embodiment of the present disclosure. As discussed in more detail below, the conduit 12 may be any of a variety of fluid conduits configured to support a fluid in a drilling system and/or a production system.

As shown, a channel 14 is fluidly coupled to the conduit 12 and extends from a radially-outer surface 16 (e.g., annular surface or side wall) of the conduit 12. In this illustrated embodiment, the channel 14 includes a first end 18 that is fluidly coupled to a first portion 20 of the conduit 12 and a second end 22 that is fluidly coupled to a second portion 24 of the conduit 12. In operation, fluid from the conduit 12 may pass into the channel 14 via the first end 18, flow through the FAMS 10, and subsequently return to the conduit 12 via the second end 22. As discussed in more detail below, the FAMS 10 may include one or more isolation assemblies (e.g., valves) to control flow of the fluid into and out of the FAMS 10 and/or the FAMS 10 may include one or more sensors to monitor respective characteristics (e.g., parameters) of the fluid as the fluid flows through the FAMS 10. In some embodiments, the channel 14 extends into and through the FAMS 10, and the channel 14 and/or the other components of the FAMS 10 are formed within and/or supported within a housing 26 (e.g., FAMS housing). In some embodiments, the housing 26 may be configured to be coupled (e.g., removably coupled, such as via fasteners, fixedly attached, such as via welded joints, or integrated within) to the conduit 12 and/or to other structures proximate to the conduit 12 to fluidly couple the channel 14 and the FAMS 10 to the conduit 12.

To facilitate discussion, the FAMS 10 and other components may be described with reference to an axial axis or direction 28, a radial axis or direction 30, or a circumferential axis or direction 32. In the illustrated embodiment, the conduit 12 extends along the axial axis 28, and the channel 14 has a generally u-shaped cross-section having a first portion 34 and a second portion 36 that extend along the radial axis 30 and are generally crosswise (e.g., perpendicular) to the conduit 12, and a third portion 38 that extends along the axial axis 28 and joins to the first portion 34 and the second portion 36 to one another. However, it should be understood that the channel 14, may have any suitable geometry that enables extraction of the fluid from the conduit 12, flow of the fluid through the FAMS 10, and subsequent return of the fluid to the conduit 12. Furthermore, while the FAMS 10 is illustrated along the first portion 34 of the channel 14, it should be understood that the FAMS 10 may be positioned at any suitable location between the ends 18, 22 of the channel 14.

Figure 2:
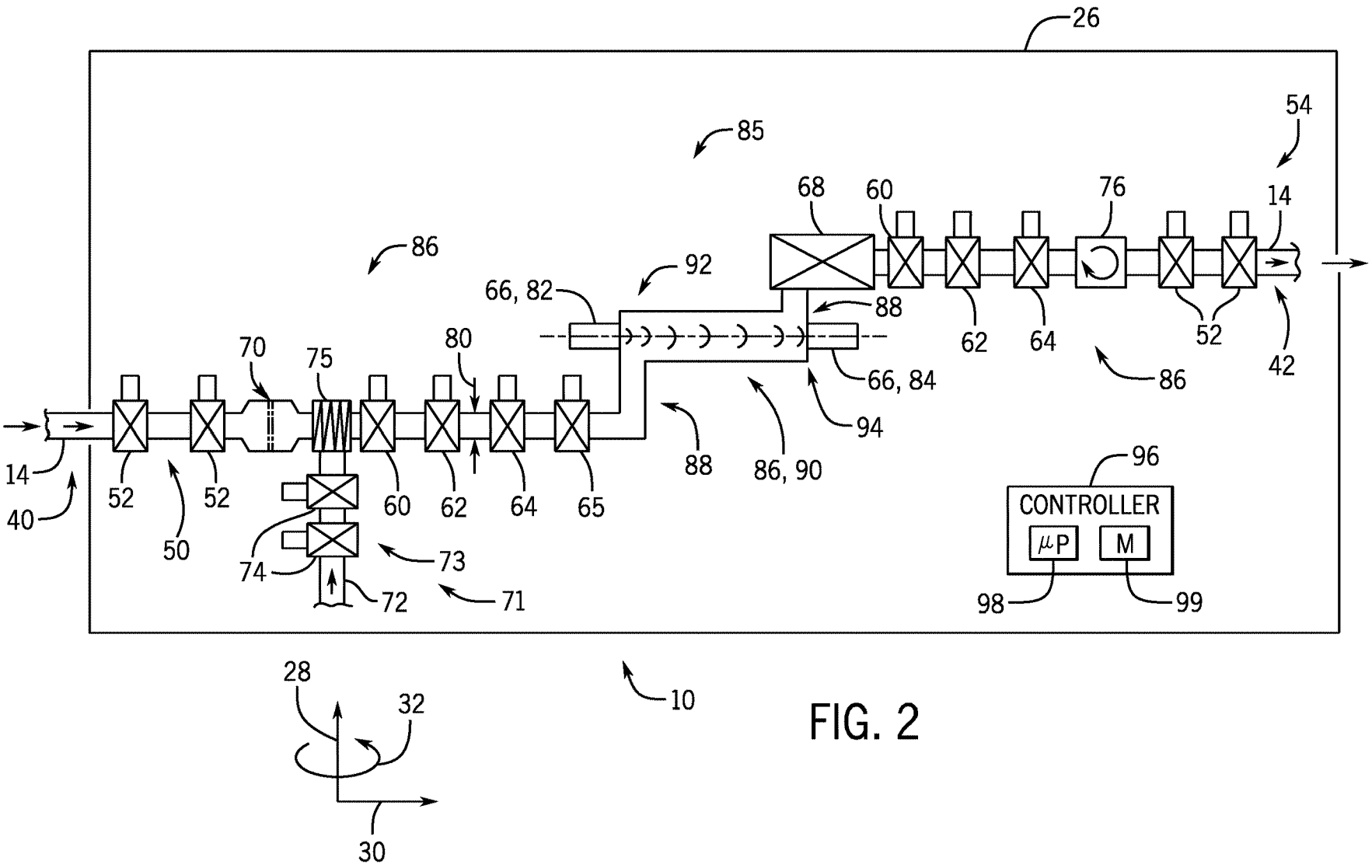
FIG. 2 is a schematic diagram of the FAMS, in accordance with an embodiment of the present disclosure.

FIG. 2 is a schematic diagram of the FAMS 10, in accordance with an embodiment of the present disclosure. In operation, the fluid may flow into a first end 40 (e.g., upstream end) of the FAMS 10 via the channel 14 and may exit a second end 42 (e.g., downstream end) of the FAMS 10 via the channel 14. As shown, the channel 14 extends through the FAMS 10 and is configured to flow the fluid through or past one or more sensors 85 within the FAMS 10 to enable the one or more sensors 85 to monitor respective characteristics of the fluid.

In the illustrated embodiment, the FAMS 10 includes a first isolation assembly 50 (e.g., double barrier isolation assembly) having two valves 52 (e.g., primary and secondary fail-closed valves) positioned proximate the first end 40 of the FAMS 10 and a second isolation assembly 54 (e.g., double barrier isolation assembly) having two valves 52 (e.g., primary and secondary fail-closed valves) positioned proximate the second end 42 of the FAMS 10. Each of the valves 52 may be configured to move between an open position to enable fluid flow across the valve 52 and a closed position to block fluid flow across the valve 52. The valves 52 may have any suitable configuration to adjust the flow of fluid through the FAMS 10 and/or to fail in the closed position to isolate the fluid (e.g., hydrocarbons) from the surrounding environment. For example, the valves 52 may be gate valves, ball valves, or the like. While the isolation assemblies 50, 54 in FIG. 2 include two valves 52, it should be understood that the isolation assemblies 50, 54 may include any suitable number (e.g., 1, 2, 3, 4, or more) of valves 52 and/or other barrier structures, such as plugs or rams, which are configured to enable and/or to block fluid flow As shown, multiple sensors 85 are positioned between the isolation assemblies 50, 54 to monitor respective characteristics of the fluid as the fluid flows through the FAMS 10. In the illustrated embodiment, the FAMS 10 includes a pressure and/or temperature sensor 60 configured to monitor the pressure and/or the temperature of the fluid, a conductivity sensor 62 configured to monitor the conductivity of the fluid, a capacitance sensor 64 configured to monitor the capacitance of the fluid, a chemical sensor 65 (e.g., gas composition sensor or carbon dioxide sensor) configured to monitor the chemical levels (e.g., gas composition or carbon dioxide levels) within the fluid, an ultrasonic sensor 66 configured to monitor attenuation of acoustic waves by the fluid, and a spectrometer assembly 68 (e.g., optical, infrared, radiation, mass, gamma-ray, nuclear magnetic resonance [NMR], and/or diffraction grating spectrometer assembly or sensor) configured to monitor absorption of light and/or energy by the fluid. Such characteristics measured by the sensors may in turn be utilized (e.g., by a controller) to determine a dielectric constant, a density, a viscosity, a free gas content, an oil content, and/or a water content of the fluid. For example, the conductivity, the capacitance, and/or the attenuation of the acoustic waves may be indicative of the density and/or the free gas content of the fluid. In certain embodiments, the light and/or energy absorption may be indicative of the free gas content, the water content, and/or the oil content of the fluid. Thus, in certain embodiments, signals generated by sensors 85 may be indicative of and used to determine a pressure, a temperature, a conductivity, a capacitance, a dielectric constant, a chemical level, a gas composition, a carbon dioxide level, an ultrasonic frequency, an ultrasonic velocity, attenuation of acoustic waves, absorption of light and/or energy, a density, a viscosity, a free gas content, an oil content, and/or a water content, for example. Such characteristics may be utilized (e.g., by a controller or by an operator) to determine appropriate outputs and/or actions. For example, certain characteristics (e.g., increase in free gas, reduced density, or the like) may indicate an influx of formation fluid within drilling mud or a potential "kick" event, and other characteristics (e.g., oil content and/or water content) may provide valuable information regarding the composition of produced fluids. It should be understood that the sensors 85 shown in FIG. 2 are provided as examples and are not intended to be limiting, and that any of a variety of sensors 85 may be utilized within the FAMS 10, including the sensors 85 discussed above, as well as viscosity sensors, density sensors, electrodes, and/or any other suitable sensors configured to monitor and to obtain signals indicative of fluid parameters, including a pressure, a temperature, a conductivity, a capacitance, a dielectric constant, a chemical level, a gas composition, a carbon dioxide level, an ultrasonic frequency, an ultrasonic velocity, attenuation of acoustic waves, absorption of light and/or energy, a density, a viscosity, a free gas content, an oil content, and/or a water content, for example. As discussed in more detail below, the signals generated by the sensors 85 may be provided to a controller (e.g., electronic controller, such as a controller 96 having a processor 98 and a memory device 99) having electrical circuitry configured to process the signals.

It should be understood that any suitable type and any suitable number (e.g., 1, 2, 3, 4, 5, 6, 7, 8, 9, 10 or more) of each type of sensor 85 may be provided within the FAMS 10. In certain embodiments, the FAMS 10 may include more than one of each type of sensor 85. For example, as shown, the FAMS 10 includes two pressure and/or temperature sensors 60, two conductivity sensors 62, and two capacitance sensors 64. Such a configuration may provide increased accuracy and/or reliability of measurements, as well as enable determination of a quality metric indicative of the accuracy and/or reliability of the measurements (e.g., based on a variation between respective measurements at a downstream sensor 85 and an upstream sensor 85 within the FAMS 10). Furthermore, the sensors 85 may be positioned to directly contact the fluid within the channel 14 and/or isolated from the fluid. For example, the pressure and/or temperature sensor 60 may be positioned within the flow path of the fluid within the channel 14 to directly contact the fluid, while the ultrasonic sensor 66 may be positioned outside of the flow path of the fluid within the channel 14.

The illustrated embodiment also includes a filter 70 (e.g., debris filter, screen, mesh) configured to filter debris or particulate matter from the fluid, a flush system 71 having a flush line 72 (e.g., a fluid conduit or passageway) configured to provide a flush fluid (e.g., clean drilling mud, sea water, oil, diesel, detergent having various chemicals, control fluid, or the like) into the channel 14 and/or the FAMS 10 and a flush line isolation assembly 73 having flush line valves 74 configured to adjust the flow of the flush fluid, and a pump 76 (e.g., a flow control device, a controllable or adjustable flow device, a variable measured circulating flow device, or an adjustable controlled volume circulation pump) configured to adjust the flow rate of the fluid through the FAMS 10. As shown, the filter 70 is positioned upstream from the sensors 85 (e.g., between the first isolation assembly 50 and the sensors 85) to remove debris from the fluid prior to monitoring the characteristics of the fluid with the sensors 85. In some embodiments, the FAMS 10 may include multiple filters 70 or a multi-stage filter.

In the illustrated embodiment, the pump 76 is positioned downstream of the sensors 85 (e.g., between the sensors 85 and the second isolation assembly 54). Such a configuration enables the pump 76 to control a flow rate of the fluid through the FAMS 10 without shearing and/or mixing the fluid prior to monitoring by the sensors 85. The pump 76 may be hydraulically, pneumatically, magnetically, or electrically actuated and may have any suitable form (e.g., rotary pump, reciprocating pump, or centrifugal pump) for circulating and/or adjusting the flow rate of the fluid through the FAMS 10. For example, the pump 76 may include a piston, rotating plates, screw, vane, or the like to pump the fluid through the channel 14. Additionally or alternatively, in some embodiments, other types of flow control devices (e.g., choke valves, flow restrictors, controllable or adjustable flow devices, or variable measured circulating flow devices) may be provided as part of the FAMS 10 and/or positioned within the housing 26, or they may be positioned at any suitable location along the conduit 12 and/or the channel 14. For example, in some embodiments, a flow restrictor (e.g., a section having a reduced cross-sectional flow area, a throat, a venturi, or the like) may be provided between the first and second portions 16, 18 of the conduit 12 to restrict flow through the conduit 12, thereby facilitating flow of fluid from the conduit 12 into the channel 14. Additionally or alternatively, a choke valve may be positioned downstream of the sensors 85 (e.g., between the sensors 85 and the second isolation assembly 54 at the location of the illustrated pump 76) to throttle fluid flow through the channel 14. The choke valve may be utilized instead of the pump 76 to control the flow rate of the fluid through the channel 14 and a flow meter may be utilized to monitor the flow rate of the fluid through the channel 14.

When the flush line valves 74 are in an open position, the flush line valves 74 may enable the flush fluid to flow through the flush line 72 into the channel 14 and/or other suitable region of the FAMS 10. In operation, the flush fluid may be utilized to flush or to clear debris trapped by the debris filter and/or to flush the channel 14. As discussed in more detail below, in certain embodiments, the flush fluid may be utilized in various processes to test the isolation assemblies 50, 54, test the sensors 85, and/or to calibrate the sensors 85. Although the illustrated embodiment includes two flush line valves 74 to create a double isolation barrier, it should be understood that any suitable number (e.g., 1, 2, 3, 4, or more) flush line valves 74 may be provided to control flow of the flush fluid and/or to isolate the channel 14 from the environment. In some embodiments, a heat source 75 (e.g., heat exchanger, electrical heater, coils, or the like) may be provided within the FAMS 10 to block (e.g., prevent) hydrate formation and/or to facilitate the flushing process.

The channel 14 through the FAMS 10 may have any suitable geometry to direct the fluid from the first end 40 to the second end 42 of the FAMS 10 and to enable monitoring by the sensors 85. In the some embodiments, the channel 14 may have a circular cross-sectional shape and/or a rectangular cross-sectional shape. For example, some portions of the channel 14 may have a circular cross-sectional shape, and other portions of the channel 14 may have a rectangular cross-sectional shape, such as between opposed plates of a particular sensor 85. In some embodiments, the channel 14 may have a width or a diameter 80 that defines a cross-sectional flow area. In some embodiments, the width or the diameter 80 may be equal to or less than approximately 1.5, 2, 2.5, or 3 centimeters (cm). In some embodiments, the width or the diameter 80 may be between approximately 1 to 5, 1.5 to 3, or 2 to 2.5 centimeters. In some embodiments, the width or the diameter 80 of the channel 14 may be equal to or less than approximately 3, 5, 10, 15, 20, or 25 percent of a diameter of the conduit 12. In some embodiments, the width or the diameter 80 (or the corresponding cross-sectional flow area) may be generally constant between the first and second ends 40, 42 of the FAMS 10. In other embodiments, the width or the diameter 80 may vary between the first and second ends 40, 42 of the FAMS 10 (e.g., the channel 14 may have a first diameter 80 at a first portion and a second diameter 80 at a second portion). In some embodiments, the width or the diameter 80 may vary based on the sensors 85, such that the channel 14 has a particular, optimized width or diameter 80 (e.g., that enables accurate and/or reliable monitoring of the fluid) for each sensor 85 at the sensor's location along the channel 14. For example, the width or the diameter 80 may be selected to enable the sensor 85 to protrude a particular, desired distance into the channel 14. In some embodiments, the FAMS 10 may include sensors 85 having a transmitter and receiver pair, and the width or the diameter 80 may be selected to enable the receiver to receive signals from the transmitter.

Additionally or alternatively, the channel 14 within the FAMS 10 may include portions that extend in different directions. For example, in the illustrated embodiments, the channel 14 includes portions 86 that extend in a first direction (e.g., radial direction 30) and portions 88 that extend in a second direction (e.g., axial direction 28). In some embodiments, the portions 86, 88 of the channel 14 may be arranged to form a chamber 90 to facilitate placement of sensors 85 at various orientations relative to fluid flow and/or to facilitate certain measurements. For example, as shown, the chamber 90 is formed by one portion 86 that extends in the first direction and is positioned between two portions 88 that extend in the second direction. Such a configuration may enable placement of sensors 85 at one or both ends of the chamber 90. In the illustrated embodiment, the FAMS 10 includes the ultrasonic sensor 66, which includes a transmitter 82 configured to emit an acoustic signal and a receiver 84 configured to receive the acoustic signal emitted by the transmitter 82. As shown, the transmitter 82 is positioned at a first end 92 of the chamber 90 and the receiver 84 is positioned at a second end 94 of the chamber 90, opposite the transmitter 82 at the first end 90. A length of the chamber 90 may enable the receiver 84 to receive signals from the transmitter 82, and furthermore, the positioning of these components at opposed ends 92, 94 of the chamber 90 enables the acoustic signal to pass through a sample of the fluid within the chamber 90 in a direction generally parallel to the fluid flow, which may facilitate monitoring of frequency shifts, amplitude changes, and/or the attenuation of the acoustic wave. It should be understood that, in certain embodiments, the ultrasonic sensor 66 may be positioned to emit acoustic waves in a direction generally transverse or perpendicular to the fluid flow, or at any of a variety of other angles (e.g., between approximately 5 to 85, 20 to 60, or 30 to 50 degrees) relative to the fluid flow.

As noted above, the FAMS 10 may include the controller 96 having the processor 98 and the memory device 99. In certain embodiments, the controller 96 may be configured to receive and to process the signals from the sensors 85 and/or to provide control signals to certain components of the FAMS 10, for example. In particular, the controller 96 may be configured to receive the signals from the sensors 85 and to process the signals (e.g., using one or more algorithms) to determine characteristics of the fluid, such as the pressure, the temperature, the conductivity, the capacitance, the dielectric constant, the chemical level, the gas composition, the carbon dioxide level, the ultrasonic frequency, the ultrasonic velocity, attenuation of acoustic waves, absorption of light and/or energy, the density, the viscosity, the free gas content, the oil content, and/or the water content, for example.

In certain embodiments, the controller 96 may be configured to analyze the sensor data (e.g., the signals or the determined characteristics). In some embodiments, the controller 96 may compare the sensor data obtained by one or more sensors 85 within one FAMS 10 at different times to identify changes in the fluid over time. Such analysis may be particularly useful in monitoring changes in fluids produced by a well over time, for example. Additionally or alternatively, in some embodiments, the controller 96 may compare sensor data obtained by one or more sensors 85 of multiple different FAMS 10 positioned at different locations of the drilling system and/or the production system at different times or in real time or at the same time to identify changes in the fluid during the drilling and/or production process. Such analysis may be particularly useful in monitoring changes in supplied fluids during drilling processes, for example.

In some embodiments, the controller 96 may be configured to provide an output (e.g., visual or audible output or an instruction or control signal) based on the sensor data. For example, the controller 96 may be configured to provide a visual or audible output that indicates the determined characteristic, a trend or a change in the determined characteristic over time, a rate of change of the determined characteristic over time, a change in the determined characteristic as compared to a predetermined acceptable range (e.g., upper threshold, lower threshold, or both) and/or baseline data (e.g., historical data, known data, modeled data, sensor data obtained by the same FAMS 10 at a previous time, sensor data obtained by one or more upstream FAMS 10 or one or more other FAMS 10 within the drilling and/or production system at a previous time or at the same time, or the like).

In some embodiments, the controller 96 may be configured to initiate an alarm (e.g., a visual or audible alarm, such as a textual warning message or beep) if certain characteristics, changes, and/or rates of change exceed or differ from predetermined acceptable ranges and/or baseline data. In some embodiments, the controller 96 may be configured to provide a prompt, such as instructions to perform maintenance or repair operations, conduct further monitoring using certain FAMS 10 and/or certain sensors 85 within certain FAMS 10, flush the channel 14, to close the well, actuate the diverter, or the like, based on the characteristics, the changes, and/or rates of change in the characteristics. For example, if the controller 96 determines (e.g., based on signals from the sensors 85 and using one or more algorithms) that the characteristics, changes in the characteristics, and/or rate of change of the characteristics (e.g., a change in free gas between one FAMS 10 upstream of the wellbore and another FAMS 10 downstream of the wellbore) indicate a sudden influx of formation fluid within drilling mud in the conduit 12, commonly known as a "kick," the controller 96 may provide an alarm and/or instructions to actuate the diverter to divert fluid from the platform and/or to the BOP to seal the annulus to control fluid pressure in the wellbore.

In some embodiments, the controller 96 may be configured to provide control signals to various components of the FAMS 10 and/or the drilling and/or production system based on the characteristics, the changes, and/or the rate of change in the characteristics. For example, in some embodiments, the controller 96 may provide control signals to automatically repeat measurements using one or more sensors 85 of the FAMS 10, flush the channel 14, activate certain sensors 85 within one or more other FAMS 10 within the drilling and/or production system, close the BOP assembly, actuate the diverter, or the like In some embodiments, the controller 96 may be configured to initiate the alarm, provide the prompt, and/or provide the control signals if sensor data 85 from one or more FAMS 10 varies from a predetermined acceptable range and/or baseline data by more than 1, 2, 3, 4, 5, 6, 7, 8, 9, 10,15, or 20 percent and/or if the characteristic, change, and/or rate of change indicates a kick event or other event. In some embodiments, the controller 96 may be configured to receive respective signals from multiple FAMS 10 distributed about the drilling and/or production system, analyze the signals together (e.g., using one or more algorithms) to determine whether the signals indicate a kick event or otherwise indicate atypical fluid composition or atypical fluid changes or rates of change, and to provide the information, alarm, prompt, and/or control signals in the manner set forth above.

In certain embodiments, the controller 96 may be configured to control the various components of the FAMS 10, including the sensors 85, the valves 52, 74, and/or the pump 76. For example, the controller 96 may be configured to provide a control signal to the valves 52, 74 to cause the valves 52, 74 to move between an open position and a closed position, a control signal to the ultrasonic sensor 66 to cause the transmitter 82 to emit an acoustic wave, and/or a control signal to control the pump 76 to adjust the flow rate of the fluid through the channel 14. In some embodiments, the controller 96 may be configured to activate or to operate the components of the FAMS 10 in a predetermined sequence or according to a predetermined program. Certain sensors 85 may provide accurate and/or reliable measurements of the fluid under particular conditions (e.g., flow rate, turbulent flow, laminar flow, stationary or stagnant, pressure, temperature, or the like). Thus, in some embodiments, the processor 98 may control the pump 76 to adjust the flow rate to a first flow rate that is appropriate for a first sensor 85 and may then activate the first sensor 85 to measure a respective characteristic of the fluid. Subsequently, the processor 98 may control the pump 76 to adjust the flow rate to a second flow rate, different from the first flow rate and that is appropriate for a second sensor 85, and the processor may then activate the second sensor 85 to measure a respective characteristic of the fluid. The controller 96 may be configured to operate the valves 52, 74, sensors, and/or the pump 76 periodically (e.g., at predetermined intervals) during drilling and/or production processes and/or in response to a control signal generated in response to a user input, measured characteristics, or the like.

The controller 96 may be located at any suitable location to enable the controller 96 to receive signals from the sensors 85 of the FAMS 10 and/or to control components of the FAMS 10. For example, the controller 96 may be positioned within the housing 26, within a separate support structure coupled to the housing 26, and/or at a location remote from the housing 26 (e.g., surface location). As discussed in more detail below, in certain embodiments, the controller 96 may be part of a distributed controller or control system with one or more controllers (e.g., electronic controllers with processors, memory, and instructions) distributed about the drilling system or the production system and in communication with one another to receive and/or to process the signals from one or more FAMS 10, to provide an output, and/or to control the components of the FAMS 10. For example, as discussed in more detail below, one controller (e.g., the controller 96) may be positioned within the housing 26 of the FAMS 10 and may be configured to receive and to process the signals from the sensors 85 of the FAMS 10 and another controller may be positioned in a remote or topside base station that is configured to determine and/or to provide the appropriate output (e.g., via a display for visualization by an operator). In some embodiments, one controller (e.g., the controller 96) may be configured to control the components of the FAMS 10 and to provide the signals generated by the sensors 85 to another controller, which may include a processor configured to aggregate data or signals from the sensors 85 of multiple different FAMS 10 and to provide the appropriate output. Thus, the controller 96 may not further process the raw data obtained by the sensors 85, but rather the controller 96 may store the raw data (e.g., in the memory device 99) and/or facilitate communication of the data to another controller (e.g., a controller of a remote base station) for further processing. Thus, the controller 96 may carry out some or all of the processing steps with respect to the signals obtained from the sensors 85 of the FAMS 10.

It should be understood that any of the controllers disclosed herein (e.g., the controller 96) may include respective a processor (e.g., the processor 98), a respective memory device (e.g., the memory device 99), and/or one or more storage devices and/or other suitable components. Furthermore, the processors disclosed herein may be used to execute software, such as software for processing signals and/or controlling the components of the FAMS 10. Moreover, the processors may include multiple microprocessors, one or more "general-purpose" microprocessors, one or more special-purpose microprocessors, and/or one or more application specific integrated circuits (ASICS), or some combination thereof. For example, the processors may include one or more reduced instruction set (RISC) or complex instruction set (CISC) processors. The memory devices disclosed herein may include a volatile memory, such as random access memory (RAM), and/or a nonvolatile memory, such as ROM. The memory devices may store a variety of information and may be used for various purposes. For example, the memory devices may store processor-executable instructions (e.g., firmware or software) for the processors to execute, such as instructions for processing signals received from the sensors and/or controlling the components of the FAMS 10. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., acceptable ranges, baseline data, sensor data, desired flow rates or pump parameters, or the like), instructions (e.g., software or firmware for controlling the components of the FAMS 10, or the like), and any other suitable data.

Advantageously, the FAMS 10 may enable real-time fluid monitoring under controlled conditions (e.g., flow rate, pressure, temperature, or the like) within the channel 14 and/or may provide a configuration that enables the sensors 85 to obtain accurate and/or reliable measurements. Additionally, the FAMS 10 may monitor the fluid regardless of fluid flow within the conduit 12 (e.g., regardless of whether the fluid flow within the conduit 12 is turbulent, stationary or stagnant, or the like) and/or regardless of whether drilling equipment is positioned within the conduit 12, for example.

It should be understood that the FAMS 10 may include some or all of the components shown in FIG. 2 and/or that other components may be added. Furthermore, such components may have any suitable arrangement (e.g., order, spacing, relative positioning, or the like) within the FAMS 10. Additionally, the components of the FAMS 10 may be controlled by any suitable control system having one or more controllers, such as the controller 96. As used herein, the terms upstream and downstream are defined with respect to a flow path of the fluid. For example, in the illustrated embodiment, the first end 40 of the FAMS 10 is upstream from the second end 42 of the FAMS 10 because the fluid flows from the first end 40 toward the second end 42.

Figure 3:
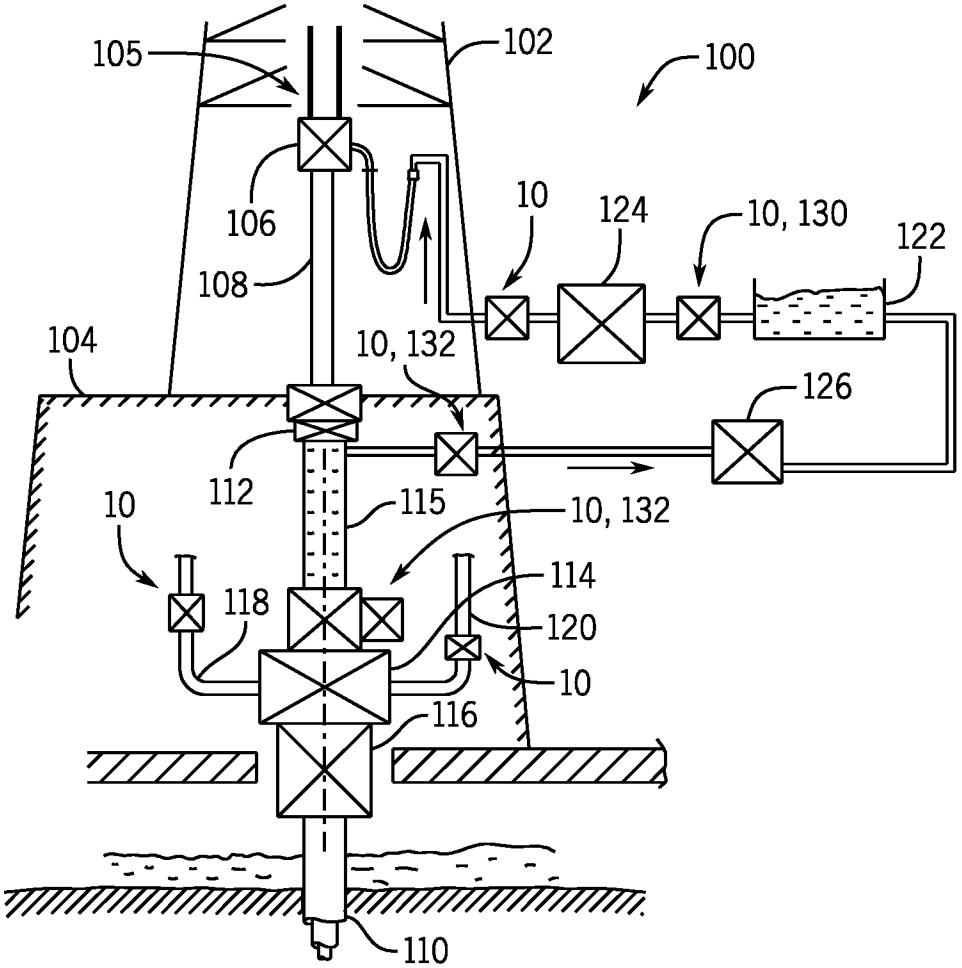
FIG. 3 is a schematic diagram showing multiple FAMS positioned at various locations within a surface drilling system, in accordance with an embodiment of the present disclosure.

FIGS. 3-8 are schematic diagrams showing the FAMS 10 positioned at various locations within drilling and/or productions systems. In particular, FIG. 3 is a schematic diagram showing multiple FAMS 10 positioned at various locations within a surface drilling system 100, in accordance with an embodiment of the present disclosure. As shown, the system 100 includes a mast 102 (e.g., derrick) positioned on a drill floor 104. The system 100 may include a hoisting system 105 having a kelly or top drive 106. The hoisting system 105 may be used to raise and to lower drilling equipment relative to the drill floor 104, and the top drive 106 may be used to support and/or to rotate the drilling equipment. As shown, a drill pipe 108 (e.g., drill string) is suspended from the top drive 106 and extends through the drill floor 104 into a wellbore 110. The system 100 may include various other components, such as a diverter 112 (or rotating control device in a managed pressure drilling system), a blowout preventer (BOP) assembly 114 having one or more ram and/or annular BOPs, a bell nipple 115 (e.g., annular pipe), and a wellhead 116. As shown, a choke line 118 and a kill line 120 extend from the BOP assembly 114 to direct fluid to a fluid processing system at the drill floor 104 or other location.

During drilling operations, the top drive 106 may rotate the drill pipe 108 to facilitate drilling the wellbore 110 and drilling mud may be pumped from a mud tank 122 (e.g., storage tank) through the drill pipe 108 toward the wellbore 110 via a mud pump 124. The drilling mud may return toward the drill floor 104 via an annular space between the drill pipe 108 and the bell nipple 15. The diverter 112 may divert the drilling mud toward a mud processing device 126 (e.g., shale shaker), which may separate debris or particulate matter from the drilling mud prior to returning the drilling mud to the mud tank 122.

As shown, respective FAMS 10 may be positioned upstream of the drill pipe 108, such as between the mud tank 122 and the mud pump 124 and/or between the mud pump 124 and the drill pipe 108, axially above the BOP assembly 114 (e.g., between the BOP assembly 114 and the diverter 112), along the choke line 118, along the kill line 120, and/or between the bell nipple 115 and the mud processing device 126, for example. In certain embodiments, the sensor data or characteristics of the fluid (e.g., drilling mud) obtained by the various FAMS 10 may be compared to one another, to predetermined acceptable ranges, and/or to baseline data (e.g., by the controller 96). For example, a first FAMS 10, 130 (e.g., an upstream FAMS) may be positioned to obtain a first set of characteristics (e.g., baseline data) of the fluid prior to injection into the drill pipe 108 and/or the wellbore 110. A second FAMS 10, 132 (e.g., a downstream FAMS or return FAMS) may be positioned to obtain a second set of characteristics after the fluid flows through the drill pipe 108 and/or during or after return of the fluid to the surface.

In certain embodiments, the characteristics of the fluid measured by each FAMS 10 may be compared to the first set of characteristics and/or to characteristics measured by other FAMS 10 to facilitate determination of a condition of the fluid and/or to detect unacceptable changes (e.g., more than 1, 2, 3, 4, 5, 6, 7, 8, 9, 10, 15, or 20 percent) and/or to detect unacceptable rates of changes in the characteristics of the fluid during the drilling process. For example, comparison of the second set of characteristics to the first set of characteristics may provide an indication of the presence of free gas, increased oil or gas content, or the like, which may prompt a control system (e.g., having the controller 96) to provide an appropriate output, such as an alarm, a prompt, a control signal to actuate valves to block fluid flow, or the like.

Figure 4:
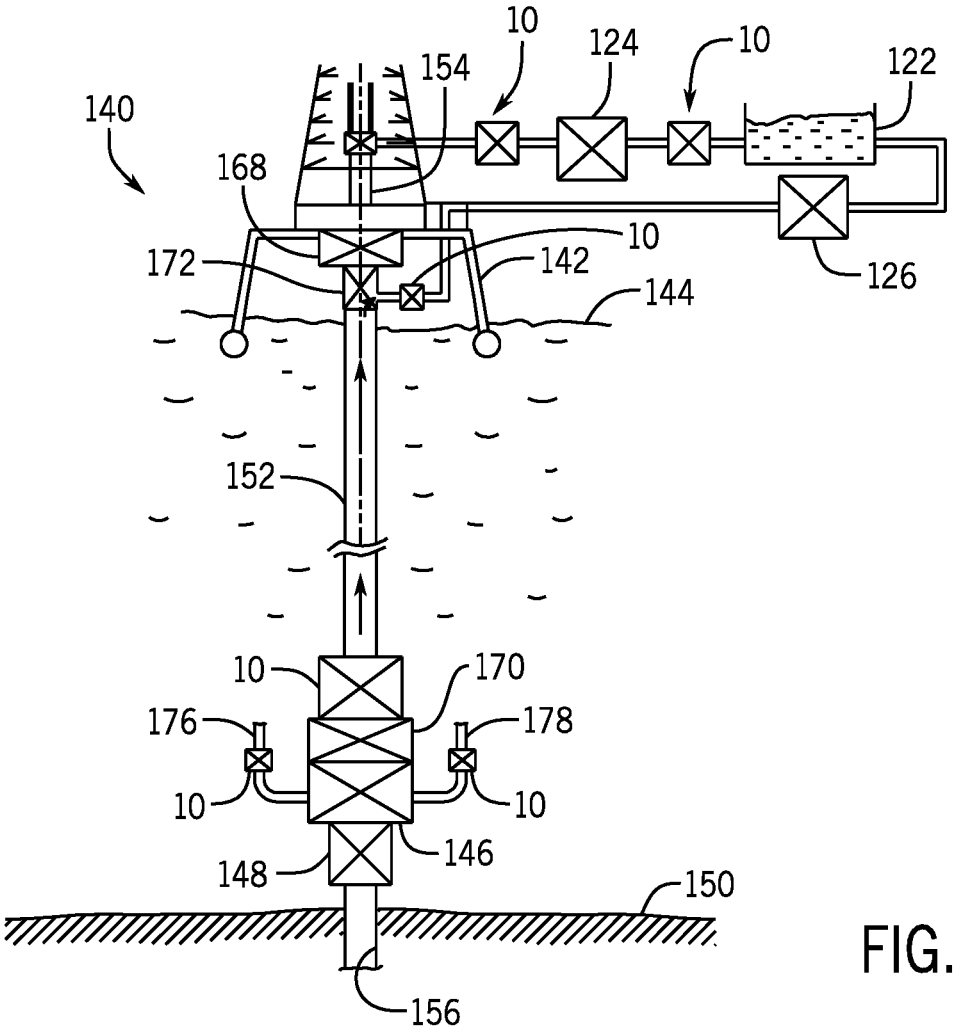
FIG. 4 is a schematic diagram showing multiple FAMS positioned at various locations within a subsea drilling system, in accordance with an embodiment of the present disclosure.

FIG. 4 is a schematic diagram showing multiple FAMS 10 positioned at various locations within a subsea drilling system 140, in accordance with an embodiment of the present disclosure. As shown, the system 140 includes an offshore vessel or platform 142 at a sea surface 144. A BOP stack assembly 146 is mounted to a wellhead 148 at a sea floor 150, and a tubular drilling riser 152 extends from the platform 142 to the BOP stack assembly 146. Downhole operations are carried out by a drill pipe 154 (e.g., drill string) that extends from the platform 142, through the riser 152, through the BOP stack assembly 146, and into a wellbore 156. The system 140 may include various other components, such as a diverter 168, a lower marine riser package 170 (LMRP) having one or more annular BOPs, and a bell nipple 172 (e.g., annular pipe). As shown, a choke line 176 and a kill line 178 extend from the BOP assembly 146 to direct fluid to a fluid processing system at the platform 142 or other location.

During drilling operations, the drill pipe 154 may rotate to drill the wellbore 156 and drilling mud may be pumped from the mud tank 122 through the drill pipe 154 toward the wellbore 156 via the mud pump 124. The drilling mud may return toward the platform 142 via an annular space between the drill pipe 154 and the riser 152. The diverter 168 may divert the drilling mud toward a mud processing device 126 at the platform 142 or other location, which may separate debris or particulate matter from the drilling mud prior to returning the drilling mud to the mud tank 122.

As shown, respective FAMS 10 may be positioned upstream of the drill pipe 154, such as between the mud tank 122 and the mud pump 124 and/or between the mud pump 124 and the drill pipe 154, axially above the BOP assembly 146 and the LMRP 170 (e.g., between the LMRP 170 and the diverter 168), along the choke line 176, along the kill line 178, and/or between the bell nipple 172 and the mud processing device 126, for example. In certain embodiments, the sensor data or characteristics of the fluid (e.g., drilling mud) obtained by the various FAMS 10 may be compared to predetermined acceptable ranges and/or baseline data to determine a condition of the fluid, provide an output, or the like, as discussed above with respect to FIGS. 2 and 3, for example. In certain embodiments, control lines (e.g., umbilicals) may extend from the FAMS 10 positioned at subsea locations to the surface to enable exchange of signals between surface control systems and the FAMS 10.

Figure 5:
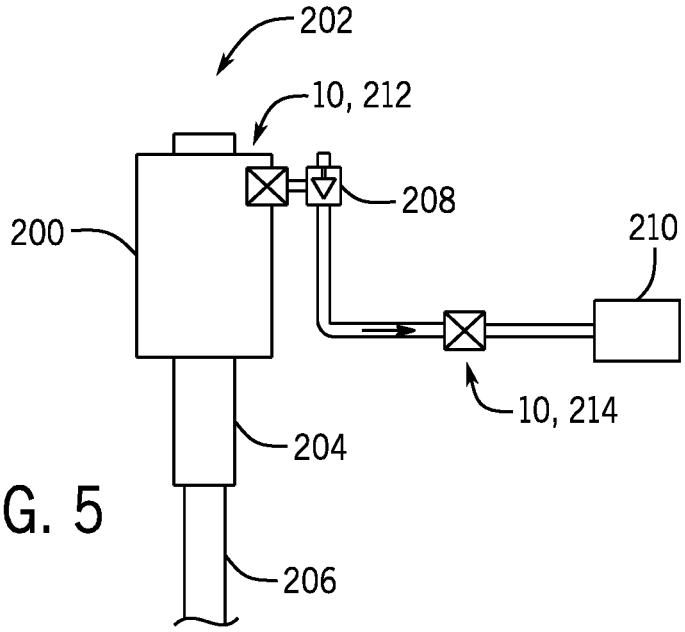
FIG. 5 is a schematic diagram showing multiple FAMS positioned at various locations about a surface tree of a surface production system, in accordance with an embodiment of the present disclosure.

FIG. 5 is a schematic diagram showing multiple FAMS positioned at various locations within a surface tree 200 of a surface production system 202, in accordance with an embodiment of the present disclosure. The surface tree 200 may include various fluid control devices, such as various valves (e.g., isolation valves), and may be mounted on a wellhead 204 positioned above a conductor pipe 206 (e.g., casing) that extends into the wellbore. As shown, a choke valve 208 may be provided to control a flow rate of a fluid (e.g., production fluid) extracted from a well via the surface production system 202 to a downstream processing system 210 (e.g., manifold and/or processing devices). In certain embodiments, FAMS 10 may be positioned on one or both sides (e.g., an upstream and/or a downstream side) of the choke valve 208. A first FAMS 10, 212 upstream of the choke valve 208 may enable detection of water content and/or free gas at the surface tree 200. As shown, a second FAMS 10, 214 is positioned downstream of the choke valve 208 and may enable analysis of the fluid under reduced pressure (e.g., as compared to the first FAMS 10, 212). In certain embodiments, the second FAMS 10, 214 may be configured to detect free gas, which may in turn be compared to the free gas detected by the first FAMS 10, 212 and/or to various acceptable predetermined ranges and/or baseline data and/or used (e.g., in algorithms by a control system) to detect changes in content of the fluid produced by the well over time, for example. In some embodiments, data from the illustrated FAMS 10 may advantageously indicate characteristics of the fluid before the fluid is comingled or mixed with fluids from other wells. Such data may enable a controller or an operator to adjust downstream processing (e.g., to handle gas, water, oil, etc.), to select various wells and/or mix fluid produced by different wells at different times to produce a desired comingled flow, or the like, which in turn may improve field production efficiency and reduce costs.

Figure 6:
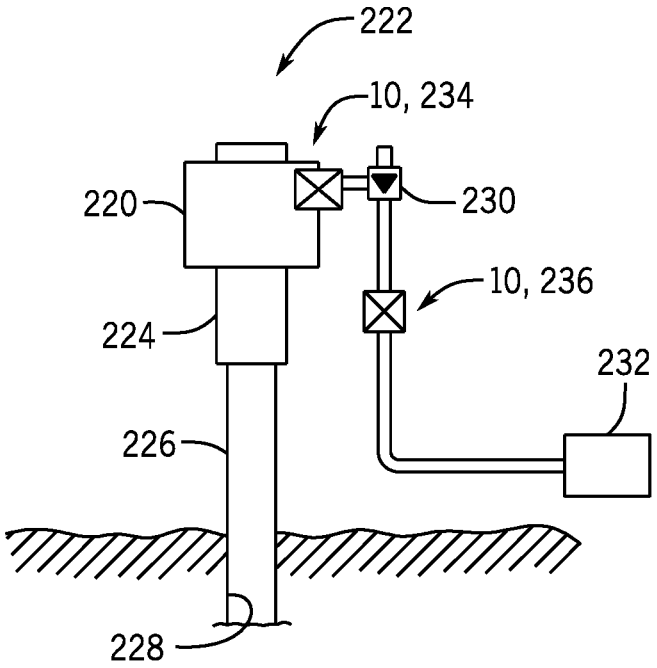
FIG. 6 is a schematic diagram showing multiple FAMS positioned at various locations about a subsea tree of a subsea production system, in accordance with an embodiment of the present disclosure.

FIG. 6 is a schematic diagram showing multiple FAMS 10 positioned at various locations within a subsea tree 220 of a subsea production system 222, in accordance with an embodiment of the present disclosure. The subsea tree 220 may include various fluid control devices, such as various valves (e.g., isolation valves), and may be mounted on a wellhead 224 positioned above a conductor pipe 226 (e.g., casing) that extends into a wellbore 228. As shown, a choke valve 230 may be provided to control a flow rate of a fluid (e.g., production fluid) extracted from a well via the subsea production system 222 to a downstream processing system 232 (e.g., manifold and/or processing devices). In certain embodiments, FAMS 10 may be positioned on one or both sides (e.g., an upstream and/or a downstream side) of the choke valve 230. A first FAMS 10, 234 upstream of the choke valve 230 may enable detection of water content and/or free gas at the subsea tree 220. As shown, a second FAMS 10, 236 is positioned downstream of the choke valve 230 and may enable analysis of the fluid under reduced pressure (e.g., as compared to the first FAMS 10, 234). In a similar manner as discussed above with respect to FIG. 5, the second FAMS 10, 236 may be configured to detect free gas, which may in turn be compared to the free gas detected by the first FAMS 10, 212 and/or to various acceptable predetermined ranges and/or baseline data and/or used (e.g., in algorithms by a control system) to detect changes in content of the fluid produced by the well over time, for example. As discussed above, such data may advantageously indicate characteristics of the fluid before the fluid is comingled or mixed with fluids from other wells and may enable a controller or an operator to adjust downstream processing (e.g., to handle gas, water, oil, etc.), to select various wells and/or mix fluid produced by different wells at different times to produce a desired comingled flow, or the like, which in turn may improve field production efficiency and costs.

Figure 7:
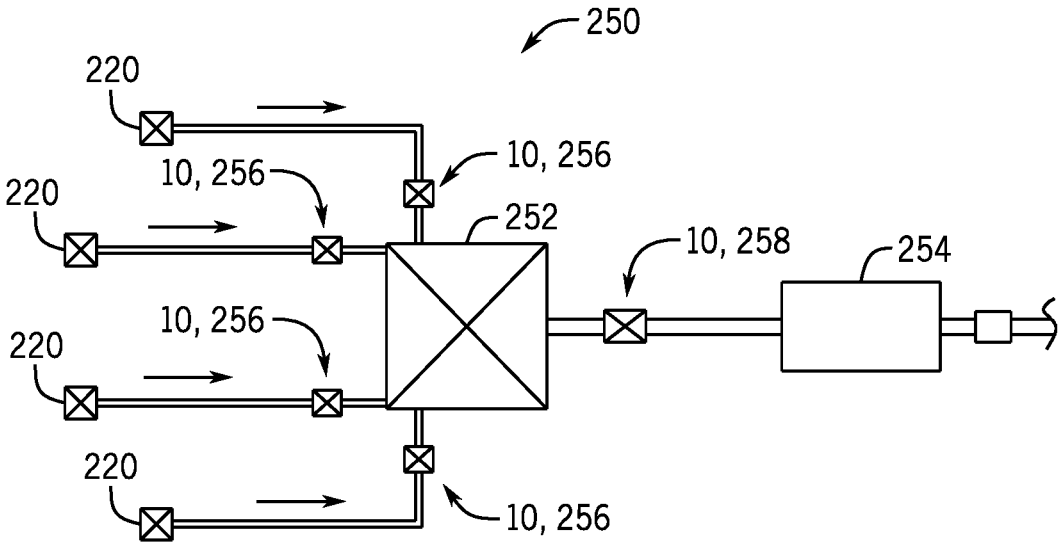
FIG. 7 is a schematic diagram showing multiple FAMS positioned about a subsea field, in accordance with an embodiment of the present disclosure.

FIG. 7 is a schematic diagram showing multiple FAMS 10 positioned about a subsea field 250, in accordance with an embodiment of the present disclosure. As shown, the subsea field 250 includes multiple subsea trees 220 each configured to extract fluid through a respective wellbore. The multiple subsea trees 220 are coupled to a manifold 252 where the fluid extracted by the multiple subsea trees 220 is comingled or mixed together, and the fluid then flows to a subsea processing system 254 (e.g., having separation devices, pumping devices, etc.) to process the fluid and to direct the fluid toward a riser extending to the sea surface, for example. As discussed above with respect to FIG. 6, multiple FAMS 10 may be provided proximate to each subsea tree 220. Additionally or alternatively, FAMS 10 may be positioned on one or both sides of the manifold 252 (e.g., on an upstream side and/or on a downstream side of the manifold 252). For example, as shown, respective first FAMS 10, 256 are positioned proximate to the manifold 252 and between each subsea tree 220 and the manifold 252, and a second FAMS 10, 258 is positioned between the manifold 252 and the subsea processing system 254.

Figure 8:
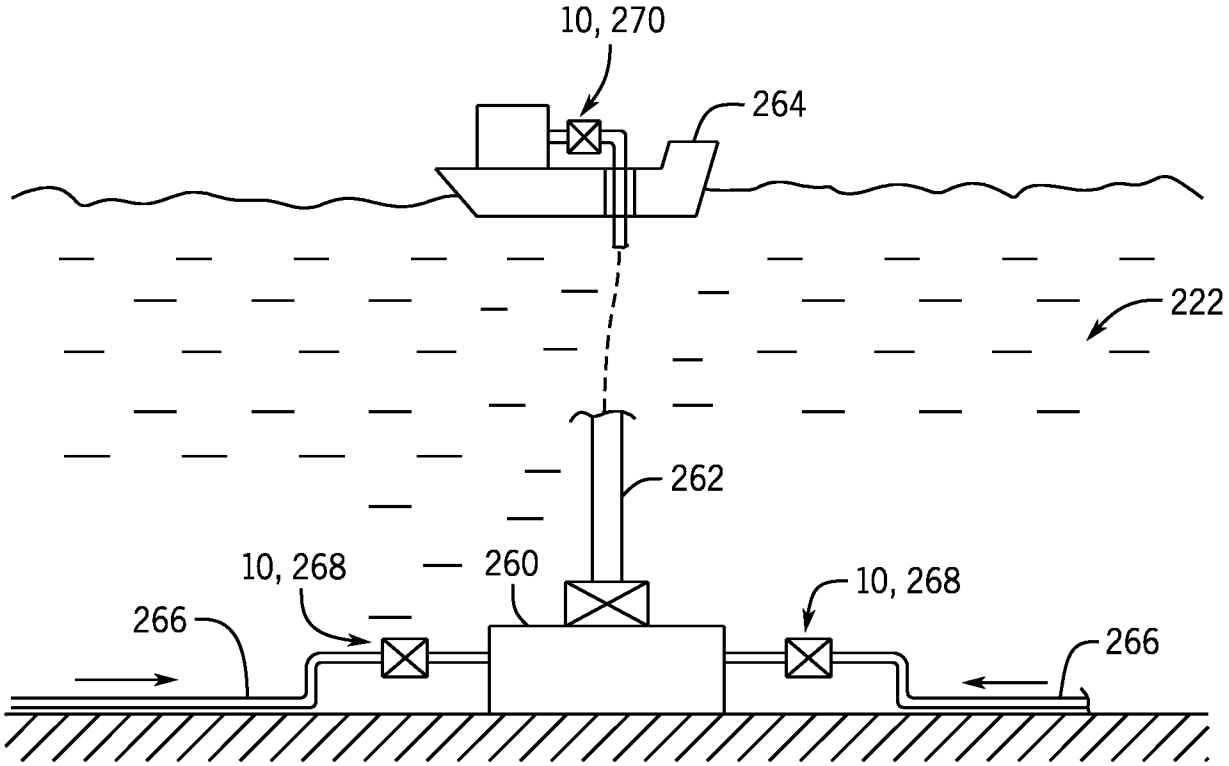
FIG. 8 is a schematic diagram showing multiple FAMS positioned about a subsea production system, in accordance with an embodiment of the present disclosure.

FIG. 8 is a schematic diagram showing multiple FAMS positioned about a portion of the subsea production system 222, in accordance with an embodiment of the present disclosure. As discussed above with respect to FIGS. 6 and 7, the system 222 may include multiple subsea trees 220, the manifold 252, the fluid processing system 254, and respective FAMS 10 positioned about these components. As shown in FIG. 8, the system 222 may also include a riser base 260 supporting a riser 262 that extends to a surface production platform or vessel 264. In operation, fluid may flow through pipelines 266 (e.g., from the subsea trees 220, manifold 252, and/or fluid processing system 254) to the riser base 260, which directs the fluid through the riser 262 to the platform 264. In addition to or as an alternative to the FAMS 10 illustrated in FIGS. 6 and 7, the system 222 may include respective FAMS 10, 268 along each pipeline 266 proximate to the riser base 260 and between the riser base 260 and the fluid processing system 254 and/or the FAMS 10, 270 at the platform 264 (e.g., a surface FAMS 10, 270 located above the sea surface).

In some circumstances, as fluid flows through extended pipelines often used in subsea production systems 222 and subsea fields 250, frictional losses may cause pressure to drop and free gas to increase. Additionally or alternatively, the fluid may partially separate, resulting in a multi-phase flow (e.g., two-phase flow, liquid and gas flow) and/or phase slugs. Thus, it may be desirable to position multiple FAMS 10 throughout the subsea field 250 and/or through the subsea production system 222, as shown in FIGS. 6-8, in order to monitor characteristics of the fluid at different locations and/or to detect changes as the fluid flows through the subsea field 250 and/or the subsea production system 222. The data from the FAMS 10 shown in FIGS. 7 and 8 may enable a controller or an operator to adjust downstream processing (e.g., to handle gas, water, oil, etc.), to select various wells and/or mix fluid produced by different wells at different times to produce a desired comingled flow, or to take other appropriate actions, which in turn may improve field production efficiency and costs.

Figure 9:
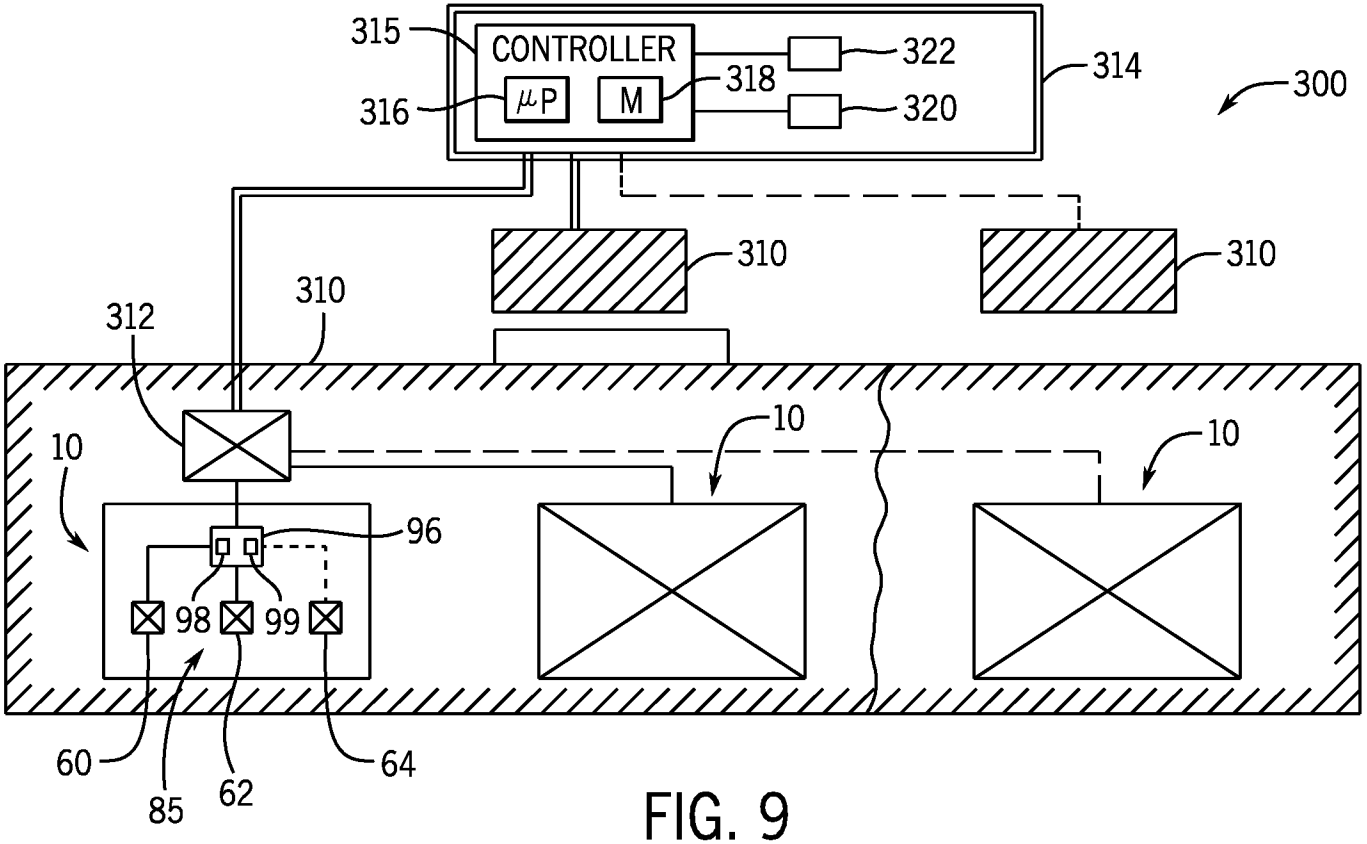
FIG. 9 is a block diagram of a control system for use with multiple FAMS, in accordance with an embodiment of the present disclosure.

FIG. 9 is a block diagram of a control system 300 for use with multiple FAMS 10, in accordance with an embodiment of the present disclosure. The control system 300 is an electronic control system having electronic controllers with processors and memory devices. As shown, each FAMS 10 may include or be coupled to a respective controller 96, which may include electrical circuitry configured to receive and/or to process signals from the sensors 85 of the FAMS 10 and/or to provide control signals to certain components of the FAMS 10, for example. In the illustrated embodiment, the controller 96 includes the processor 98 and the memory device 99. The illustrated FAMS 10 includes the pressure and/or temperature sensor 60, the conductivity sensor 62, the capacitance sensor 64 for image clarity and to facilitate discussion; however, it should be understood that the FAMS 10 may include any of a variety of sensors 85, including those discussed above with respect to FIG. 2, for example.

In certain embodiments, multiple FAMS 10 (e.g., the FAMS 10 used to monitor one subsea production system 222, the FAMS 10 used to monitor a particular portion of a drilling or production system, etc.) may be arranged into a module 310 having a module multiplexer (MUX)/de-multiplexer (DEMUX) 312 to provide signals to and/or to receive signals from a remote station 314 (e.g., at the drilling floor, at the platform at the sea surface, etc.). As shown, the remote station 314 may be coupled to multiple modules 310 (e.g., via a respective module MUX/DEMUX 312). In certain embodiments, the remote station 314 may include an electronic controller having a processor 316, a memory device 318, and/or an output device 320, such as a speaker and/or a display, to provide an output based on the signals generated by the sensors within the FAMS 10. For example, in some embodiments, the remote station 314 may be configured to provide an alarm, a prompt or recommendation via the output device 320, and/or a control signal, in the same manner discussed above with respect to the controller 96 of FIG. 2. In some embodiments, the remote station 314 includes a user interface 322 that may enable an operator to control and/or to provide instructions to the FAMS 10, such as to activate certain sensors 85 within the FAMS 10, control the pump 76, actuate valves 52 of FIG. 2 to initiate or to enable a monitoring system, or the like. As noted above, the processing and/or control features of the control system 300 may be distributed between various processors (e.g., the processor 98, the processor 316, etc.) in any suitable manner.

Figure 10:
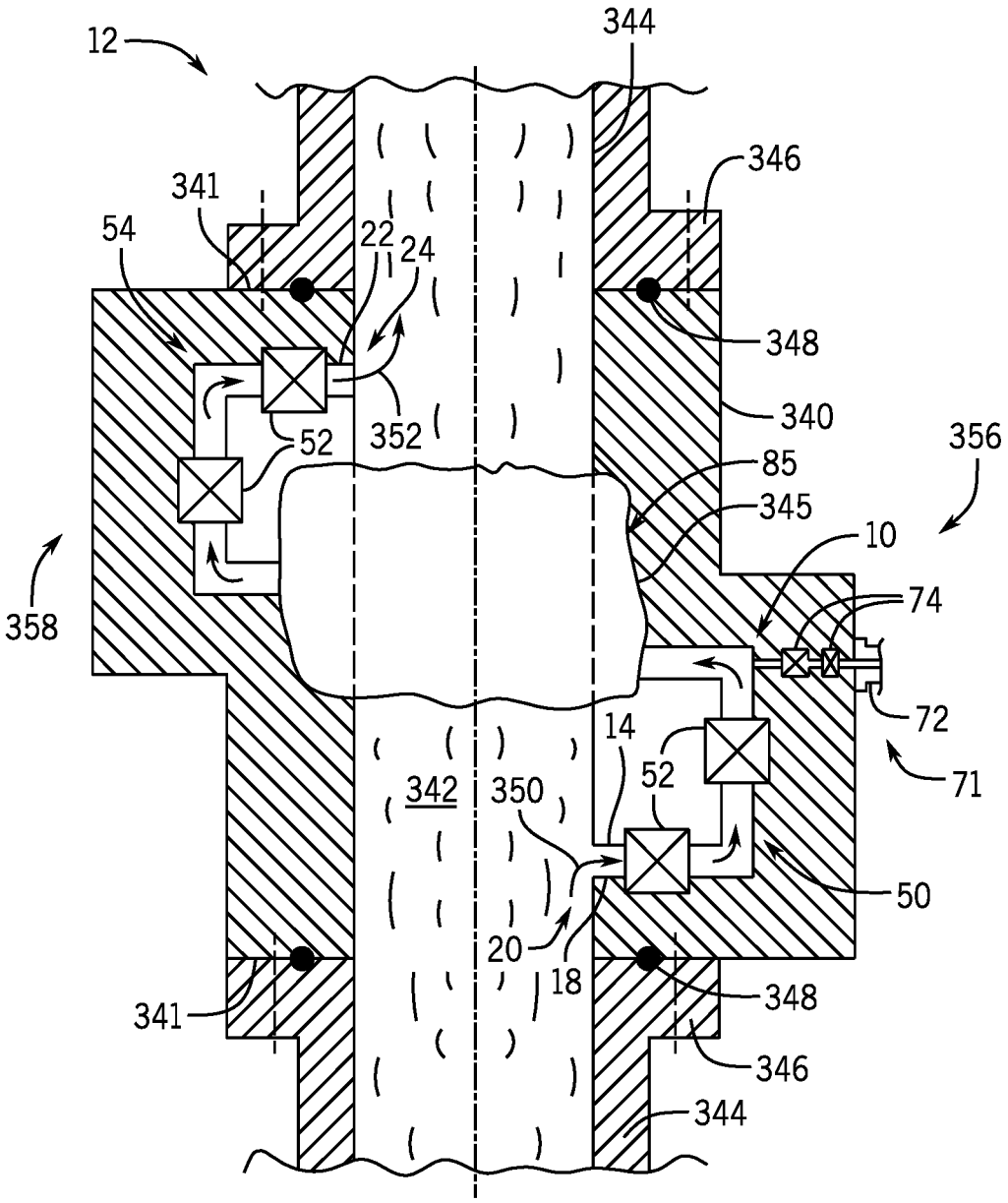
FIG. 10 is a cross-sectional side view of a FAMS positioned within a housing, in accordance with an embodiment of the present disclosure.
Figure 11:
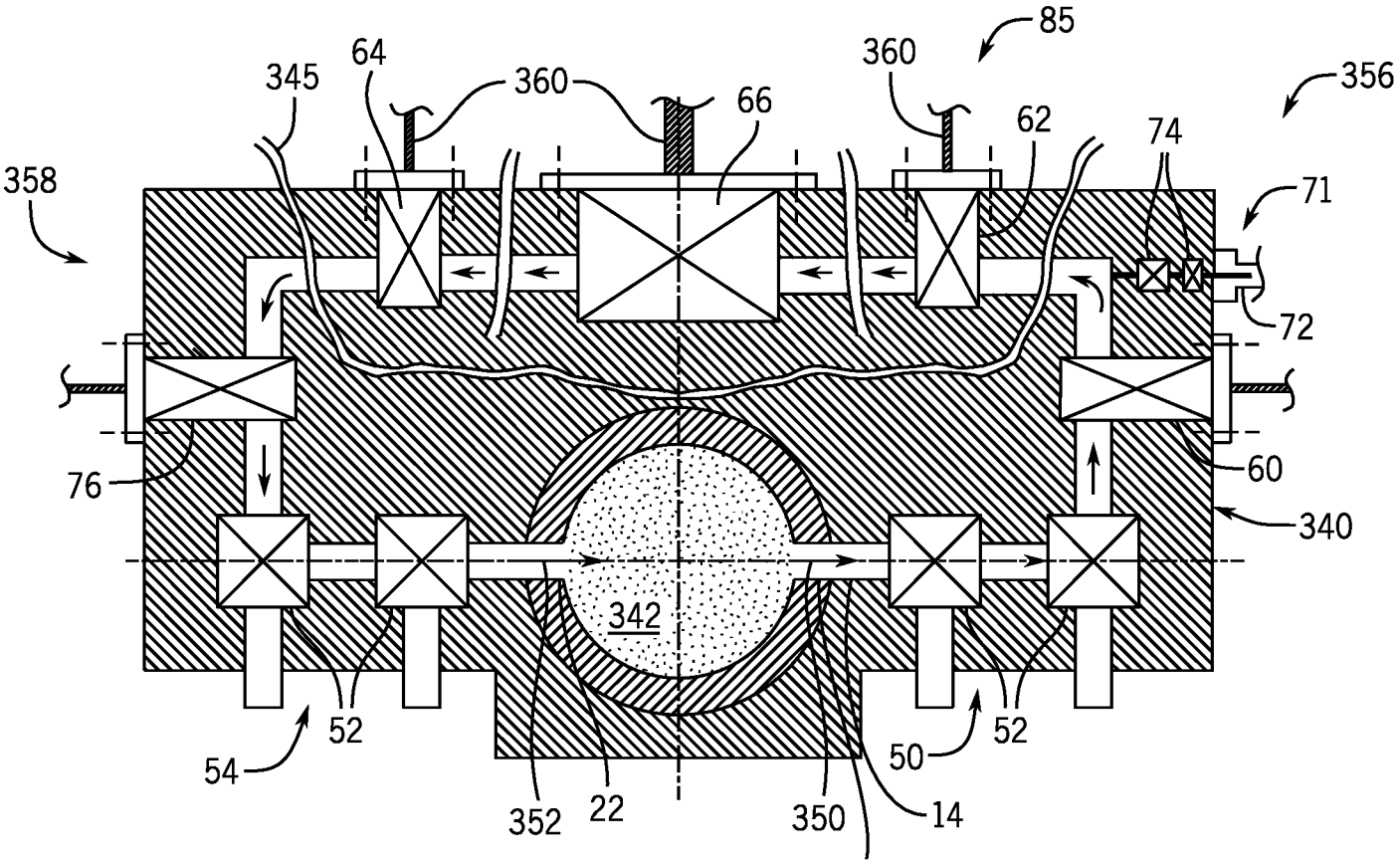
FIG. 11 is a top view of a FAMS positioned within a housing, in accordance with an embodiment of the present disclosure.

FIG. 10 is a cross-sectional side view of an embodiment of a FAMS 10 positioned within a housing 340 (e.g., FAMS housing) and FIG. 11 is a top view of an embodiment of a FAMS 10 positioned within the housing 340, in accordance with an embodiment of the present disclosure. In the illustrated embodiment, the housing 340 is an annular structure having a central bore 342 configured to align with (e.g., coaxial) and/or form part of the conduit 12 through which the fluid flows. Such a configuration may enable the housing 340 to be positioned between and to be coupled (e.g., via fasteners, such as threaded fasteners) to pipe sections 344 of the conduit 12. For example, as shown in FIG. 10, the housing 340 has mounting portions 341 (e.g., axial end surfaces) coupled to respective connectors 346 (e.g., flange or riser coupling) of the pipe sections 344, and gaskets 348 (e.g., annular gaskets) are positioned between the housing 340 and the respective connectors 346 to contain the fluid within the conduit 12 and the housing 340. Such a configuration may be particularly suitable for use with relatively large conduits 12, such as a drilling riser.

The components of the FAMS 10 may be arranged in any suitable manner within the housing 340. As shown in FIG. 10, the first end 18 of the channel 14 extends from the first portion 20 of the conduit 12, and the second end 22 of the channel 14 is coupled to the second portion 24 of the conduit 12. The first end 18 and the second end 22 of the channel 12 may be spaced apart from one another along the axial axis 30 and/or the circumferential axis 34. For example, in the illustrated embodiment, the first end 18 and the second end 22 of the channel 14 are spaced apart from one another along both the axial axis 30 and the circumferential axis 34. As shown in FIG. 11, in the illustrated embodiment, the first end 18 and the second end 22 of the channel 14 are diametrically opposed to one another across the bore 342 of the housing 340. As shown, the first isolation assembly 50 is positioned proximate to the first end 18 of the channel 14, and the second isolation assembly 54 may be positioned proximate to the second end 22 of the channel 14. In the illustrated embodiments, the flush line 72 and the flush line valves 74 are coupled to the channel 14, and the pump 76 is positioned downstream of the sensors 85 and proximate to the second isolation assembly 54. Multiple sensors 85 are positioned along the channel 14 between the first and second isolation assemblies 50, 54, with at least some of the sensors 85 within line 345 in FIGS. 10 and 11 for purposes of image clarity. As shown in FIG. 11, the illustrated FAMS 10 includes the pressure and/or temperature sensor 60, the conductivity sensor 62, the capacitance sensor 64, and the ultrasonic sensor 66 for image clarity and to facilitate discussion; however, it should be understood that the FAMS 10 may include any of a variety of sensors 85, including those discussed above with respect to FIG. 2, for example. In the illustrated embodiments, at least some of the multiple sensors 85 are positioned along a portion of the channel 14 that extends in the radial direction 32 between a first side 356 (e.g., lateral side) and a second side 358 (e.g., lateral side) of the housing 340. As shown in FIG. 11, the various components (e.g., the sensors, the pump 76, the valves 52, etc.) of the FAMS 10 may be positioned within the housing 340 to enable connection to a cable 360 (e.g., an electrical cable) that is coupled to the controller (e.g., the controller 96) positioned outside of the housing 340. However, in some embodiments, the controller may be positioned within the housing 340, and the cables 360 may extend through the housing 340 between the components and the controller such that the FAMS 10 is entirely contained within and/or supported by the housing 340.

In operation, the fluid may flow from the conduit 12 into the channel 14, as shown by arrow 350. When the first isolation assembly 50 is in an open position (e.g., the valves 52 are in an open position), the fluid may flow into the channel 14 and through or past the sensors 85 of the FAMS 10 to enable the sensors 85 to monitor characteristics of the fluid. When the second isolation assembly 54 is in the open position, the fluid may return to the conduit, as shown by arrow 352.

Figure 12:
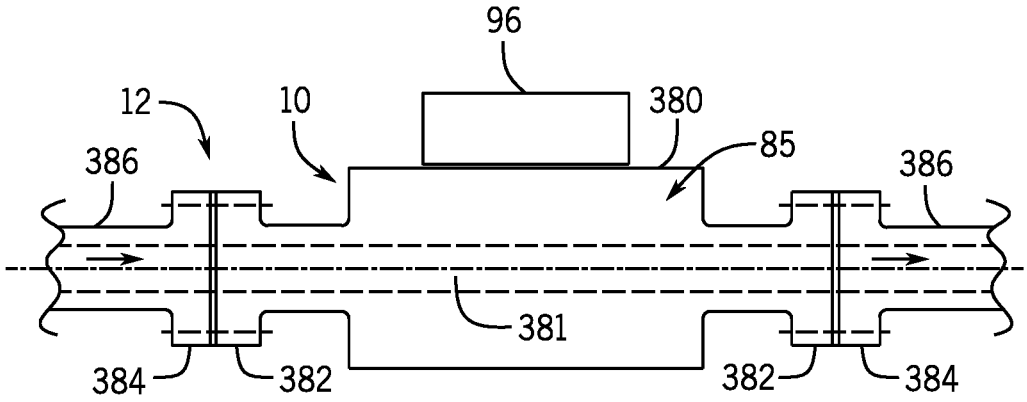
FIG. 12 is side view of a FAMS positioned within a housing, in accordance with an embodiment of the present disclosure.

The FAMS 10 may be supported within a housing having any of a variety of configurations. For example, FIG. 12 is side view of a FAMS 10 positioned within a housing 380, in accordance with an embodiment of the present disclosure. As shown, the housing 380 is an annular housing having a central bore 381 and includes connectors 382 (e.g., flanges) that are configured to mate with respective connectors 384 (e.g., flanges) of adjacent pipe sections 386 of the conduit 12. Such a configuration may enable the housing 380 to be positioned between and to align with pipe sections 386 (e.g., coaxial) to enable fluid flow through the conduit 12. Such a configuration may be particularly suitable for smaller conduits 12, such as choke lines, kill lines, and/or production pipelines, for example. The various components of the FAMS 10, including the sensors 85 and other components shown in FIG. 2, may be positioned within the housing 380.

Figure 13:
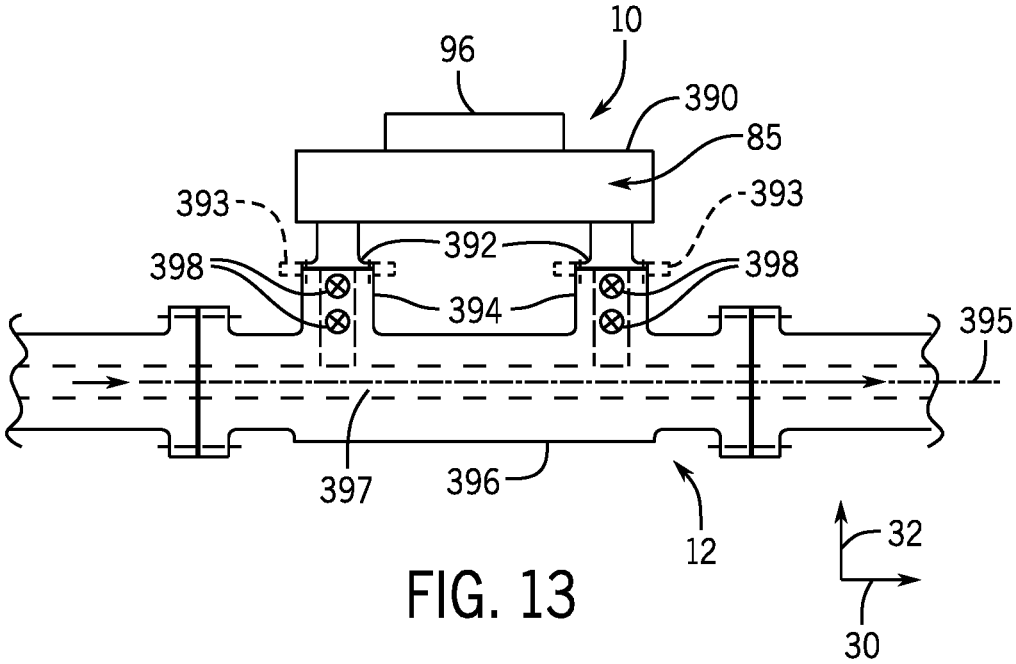
FIG. 13 is a side view of a FAMS positioned within a retrievable housing, in accordance with an embodiment of the present disclosure.

FIG. 13 is a side view of a FAMS 10 positioned within a retrievable housing 390, in accordance with an embodiment of the present disclosure. In the illustrated embodiment, the housing 390 includes connectors 392 (e.g., flanges) that are configured to mate with sections 394 (e.g., valve-supporting sections) extending radially outward from the pipe section 396 that forms the conduit 12. In certain embodiments (e.g., subsea FAMS 10), additional connectors 393 may be provided to facilitate coupling the housing 390 to the sections 394 of the pipe section 396. As shown, valves 398 may be positioned within the sections 394 to control fluid flow between the conduit 12 and the housing 390. In the illustrated embodiment, the housing 390 is offset or spaced apart from the conduit 12 in the radial direction 32 (e.g., side-mounted with laterally-extending side mounts or laterally offset from a central axis 395 of a bore 397 of the conduit 12). Such a configuration may enable the housing 390 and the FAMS 10 to be separated from the conduit 12 and retrieved with a cap on the sections 394 without disrupting or stopping flow through the conduit 12. The housing 390 may be particularly useful for monitoring fluid flow through manifolds and/or subsea equipment, as the housing 390 may enable the FAMS 10 to be removed for inspection, maintenance, repair, and/or replacement, without moving the large, heavy equipment. The various components of the FAMS 10, including the sensors 85 and the other components shown in FIG. 2, may be positioned within the housing 380.

Figure 14:
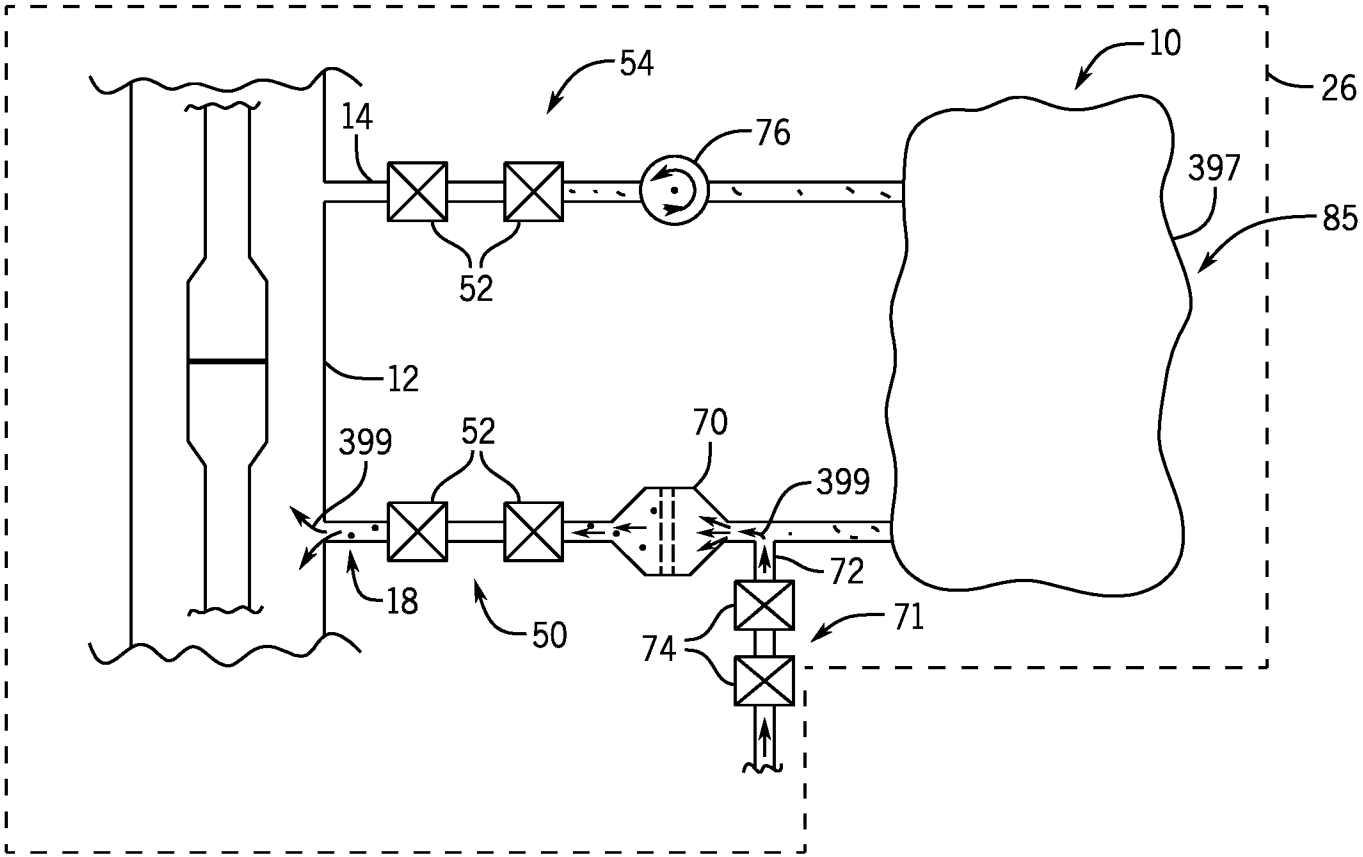
FIG. 14 is a schematic diagram illustrating a FAMS during a flushing process, in accordance with an embodiment of the present disclosure.

FIG. 14 is a schematic diagram illustrating a FAMS 10 during a flushing process, in accordance with an embodiment of the present disclosure. In the illustrated embodiment, the first isolation assembly 50 is in an open position, the second isolation assembly 54 is in a closed position, and the flush line valves 74 are in an open position. In the illustrated configuration, the flush line fluid may flow from the flush line 72, through the flush line valves 74, and through the filter 70 into the conduit 12, as shown by arrows 399, thereby flushing or cleaning the filter 70 (e.g., dislodging particulate matter from the filter 70) and a portion of the channel 14 between the flush line 72 and the first end 18 of the channel 14. In some embodiments, a series of flushes with various flush fluids may be carried out (e.g., a first flush process to remove wax and a second flush process to remove hydrates). Various other components, such as the sensors 85, may be positioned within the housing 26, such as in an area 397.

Figure 15:
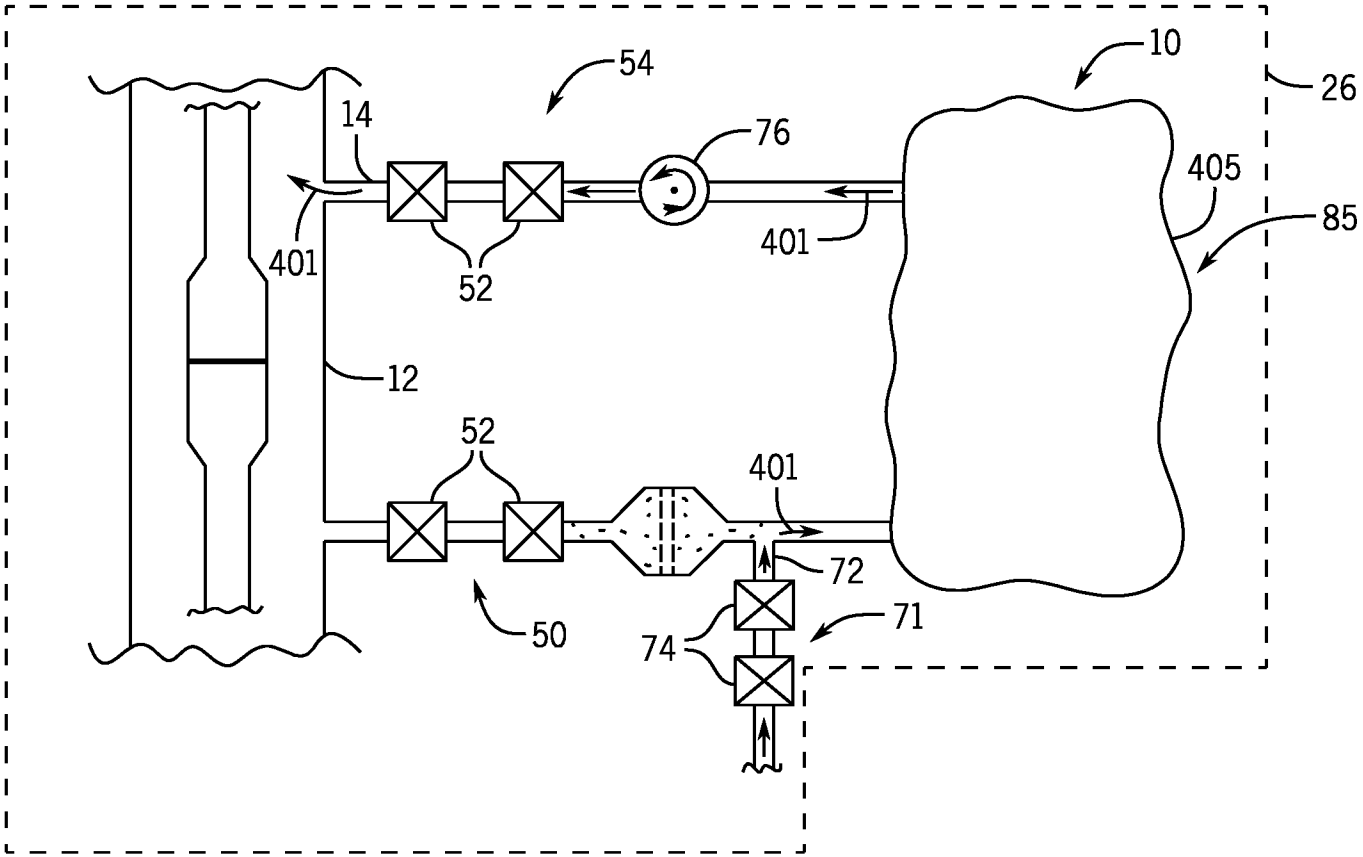
FIG. 15 is a schematic diagram illustrating the FAMS of FIG. 14 during a sensor calibration process, in accordance with an embodiment of the present disclosure.

FIG. 15 is a schematic diagram illustrating the FAMS 10 of FIG. 14 during a sensor calibration process, in accordance with an embodiment of the present disclosure. In the illustrated embodiment, the first isolation assembly 50 is in a closed position, the second isolation assembly 54 is in an open position, and the flush line valves 74 are in an open position. In the illustrated configuration, the flush line fluid may flow from the flush line 72, through the flush line valves 74, past the sensors 85 positioned along the channel 14, such as within an area 405, and through the second isolation assembly 54 into the conduit 12, as shown by arrows 401, thereby flushing or cleaning the sensors 85 and/or the portion of the channel 14 between the flush line 72 and the second end 22 of the channel 14. Such a configuration may also facilitate a sensor calibration process. For example, the flush fluid may have certain known properties or characteristics. As the flush fluid passes the sensors 85, the sensors 85 may measure respective characteristics, which may be compared to the known characteristics and/or baseline data, and the sensors 85 may be calibrated based on this comparison (e.g., coefficients or algorithms used to process signals generated by the sensors 85 during the monitoring process may be adjusted or selected based on this comparison during the calibration process). In some embodiments, a series of calibration processes with the same or different flush fluids may be carried out to improve accuracy of the calibration.

Figure 16:
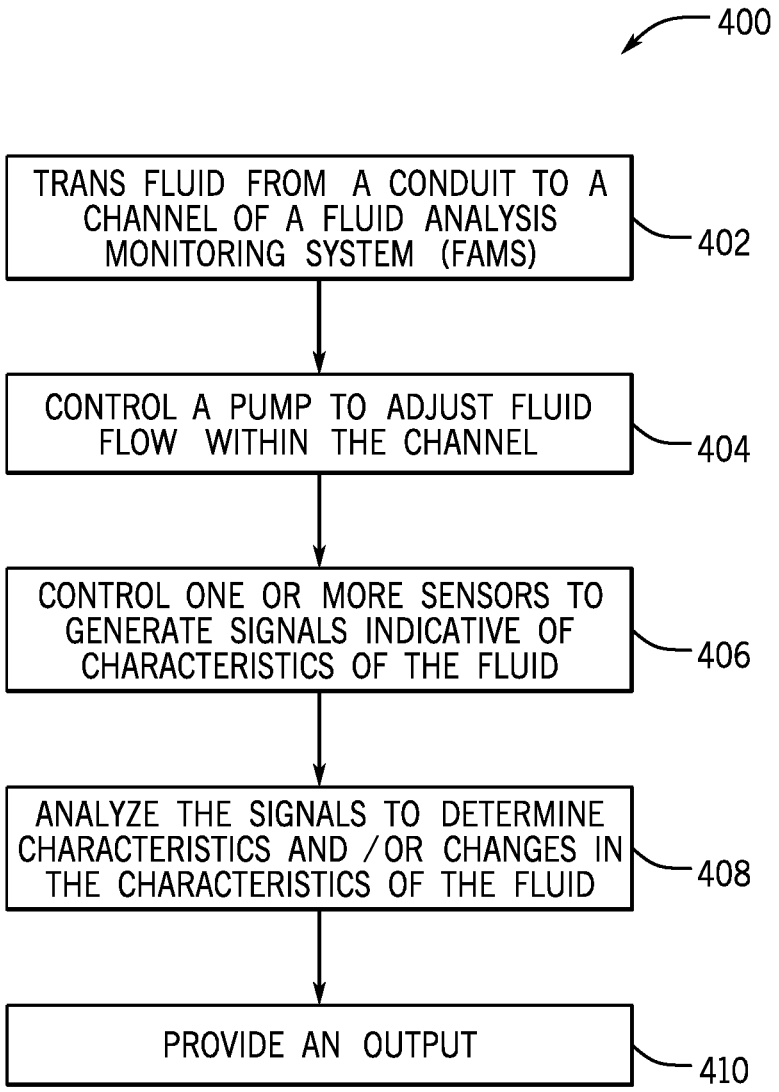
FIG. 16 is a flow diagram of a method for operating a FAMS, in accordance with an embodiment of the present disclosure.

FIG. 16 is a flow chart illustrating a method 400 for monitoring fluid within a drilling system and/or a production system, in accordance with the present disclosure. The method 400 includes various steps represented by blocks. It should be noted that the method 400 may be performed as an automated procedure by a system, such as the control system 300 of FIG. 9. Although the flow chart illustrates the steps in a certain sequence, it should be understood that the steps may be performed in any suitable order and certain steps may be carried out simultaneously, where appropriate. Further, certain steps or portions of the method 400 may be performed by separate devices. For example, a first portion of the method 400 may be performed by the processor 98, while a second portion of the method 400 may be performed by a separate processing device, such as the processor 316. As noted above, the steps of the method 400 for monitoring the fluid may be initiated automatically (e.g., according to a program stored in the memory device 99 or the memory device 318) and/or in response to operator input (e.g., via user interface 322).

The method 400 may begin when fluid is transferred from the conduit 12 to the channel 14 of the FAMS 10, in step 402. In certain embodiments, the fluid may be transferred from the conduit 12 to the channel 14 when a processor (e.g., the processor 98, the processor 316, or the like) controls the valves 52 of the first isolation assembly 50 and/or the second isolation assembly 54 to move from a closed position to the open position, for example. In step 404, the processor may control the pump 76 to circulate fluid into and through the channel 14 and/or to adjust a flow rate of the fluid through the channel 14.

In step 406, the processor may control one or more sensors 85 of the FAMS 10 to obtain signals indicative of characteristics of the fluid within the channel 14. As discussed above with respect to FIG. 2, the one or more sensors 85 may include a pressure and/or temperature sensor 60, a conductivity sensor 62, a capacitance sensor 64, a chemical sensor 65, an ultrasonic sensor 66, an spectrometer assembly 68, or any other sensor configured provide an indication of a dielectric constant, a density, a viscosity, a free gas content, a chemical level, a gas composition, an oil content, a water content of the fluid, a conductivity, a capacitance, an attenuation of acoustic waves, energy, or light, for example.

As noted above, in some embodiments, the processor may sequentially control the pump 76 and/or operate the sensors 85 at predetermined times and/or according to a predetermined sequence. For example, the processor may control the pump 76 to adjust the flow rate to a first flow rate that is appropriate for a first sensor 85 and may then activate the first sensor 85 to measure a respective characteristic of the fluid. Subsequently, the processor may control the pump 76 to adjust the flow rate to a second flow rate, different from the first flow rate and that is appropriate for a second sensor 85, and the processor may then activate the second sensor 85 to measure a respective characteristic of the fluid.

In step 408, the signals generated by the one or more sensors 85 may be received at and/or processed by a processor, such as the processor 98 or the processor 316, to determine characteristics of the fluid. For example, the signals may be processed to determine a dielectric constant, a density, a viscosity, a free gas content, an oil content, a water content of the fluid, a conductivity, a capacitance, and/or an attenuation of acoustic waves, energy, or light, for example. In some embodiments, the processor may analyze the sensor data, such as by comparing the characteristics to predetermined acceptable ranges and/or to baseline data. For example, in certain embodiments, the processor may determine a change (e.g., absolute value and/or percentage) of one or more characteristics by comparing sensor data from one or more sensors 85 of one FAMS 10 to sensor data from one or more sensors 85 of another FAMS 10.

In step 410, the processor (e.g., the processor 98 or the processor 316) may provide an output (e.g., a visual or audible output via the user interface 322 or a control signal) based on the determined characteristics. For example, the processor may be configured to provide a visual or audible output that indicates the determined characteristic, a trend or a change in the determined characteristic over time, a rate of change of the determined characteristic over time, a change in the determined characteristic as compared to a predetermined acceptable range and/or a baseline measurement, or the like. In some embodiments, the processor may be configured to initiate an alarm and/or provide a prompt. In some embodiments, the output may include control signals to control various components of the FAMS 10 and/or the drilling and/or production system. In this way, the processor may be configured to provide information related to the fluid and/or facilitate appropriate action.

The examples provided herein are not intended to be limiting and any and all of the features shown and described with respect to FIGS. 1-16 may be used in any combination with one another (e.g., positions of sensors and components with the FAMS 10, positions of FAMS 10 within the drilling and/or production system, housings, conduits, or the like). Furthermore, each FAMS 10 may be configured to perform any and all functions disclosed herein, including controlling any and all of the various sensors 85 and components of the FAMS 10, monitoring any and all of the characteristics disclosed herein, processing signals, providing outputs, communicating (e.g., exchanging signals) with other FAMS 10 and/or various components of a control system (e.g., the control system 300), for example. Each FAMS 10 may be configured to compare sensor data at one location with all other locations and/or sensor data at the same location, and the comparison may be made between the same or different sensors (and measured parameters), at same or different time (e.g., real time, same time, previous time, etc.). For example, the FAMS 10 may compare sensor data at all locations for one or more parameters at a common time (e.g., whether real time or previous time). In some embodiments, each FAMS 10 may be configured to compare sensor data to baseline data, which may be any of a variety of suitable predetermined acceptable ranges, thresholds, and/or baseline measurements such as post-calibration measurements, measurements under ideal conditions, modeled measurements, known parameters or characteristics of the fluid, current or historical measurements at the same or different FAMS 10, and/or average measurements and/or median measurements taken across FAMS 10 and/or across time, or the like. The FAMS 10 may be configured to compare sensor data in sequence of locations in a direction of flow (e.g., through the entire drilling and/or production system or portions of the flow path). Furthermore, FAMS 10 may be positioned at/in upstream and/or downstream locations of each illustrated component in FIGS. 1-16.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

one or more fluid analysis monitoring systems, each fluid analysis monitoring system comprising:

a channel comprising a first end configured to be fluidly coupled to a first portion of a conduit of a drilling system or a production system to enable fluid to flow from the conduit into the channel and a second end configured to be fluidly coupled to a second portion of the conduit to enable return of the fluid from the channel into the conduit, wherein the first end is upstream of the second end in a direction of travel of the fluid flowing through the conduit;

at least one sensor positioned along the channel and configured to generate a signal indicative of a characteristic of the fluid as the fluid flows by the at least one sensor and through the channel;

a pump positioned along the channel downstream from the at least one sensor and configured to adjust a flow rate of the fluid through the channel without shearing and/or mixing the fluid; and a controller configured to control the pump to adjust the flow rate of the fluid through the channel and configured to activate the at least one sensor based on the flow rate of the fluid through the channel;

wherein the channel is configured to form a loop when coupled to the conduit such that all of the fluid that flows from the conduit into the first end of the channel flows by the at least one sensor and is returned to the conduit via the second end of the channel.

2. The system of claim 1, wherein the conduit comprises at least one of a choke line, a kill line, a subsea pipeline, or a surface pipeline.

3. The system of claim 1, wherein the conduit comprises a subsea drilling riser.

4. The system of claim 1, wherein the pump is positioned between the at least one sensor and the second end of the channel.

5. The system of claim 1, wherein the at least one sensor comprises a pressure sensor, a temperature sensor, a conductivity sensor, a capacitance sensor, a carbon dioxide sensor, an ultrasonic sensor, a spectrometer, an optical sensor, an infrared sensor, a radiation sensor, a mass sensor, a gamma-ray sensor, a nuclear magnetic resonance sensor, a diffraction grating sensor, a viscosity sensor, a density sensor, a gas composition sensor, a chemical sensor, or any combination thereof.

6. The system of claim 1, wherein the controller is configured to receive the signal indicative of the characteristic of the fluid, compare the characteristic to a predetermined acceptable range or to a baseline measurement, and to provide an alarm if the characteristic differs from the predetermined acceptable range or the baseline measurement.

7. The system of claim 1, wherein the controller is configured to adjust the flow rate to a first flow rate and to control a first sensor of the at least one sensor to generate a respective signal while the fluid flows through the channel at the first flow rate, and to subsequently adjust the flow rate to a second flow rate, different from the first flow rate, and to control a second sensor of the at least one sensor to generate a respective signal while the fluid flows through the channel at the second flow rate.

8. The system of claim 1, wherein the one or more fluid analysis monitoring systems comprises a plurality of fluid analysis monitoring systems positioned about the drilling system or the production system, wherein the controller is configured to receive respective signals indicative of the characteristic of the fluid from each of the plurality of fluid analysis monitoring systems, to compare the respective signals to one another, and to provide an instruction to actuate a diverter based on the comparison.

9. The system of claim 1, wherein at least one of the one or more fluid analysis monitoring systems is configured to be positioned at a subsea location, and wherein the controller is configured to receive the signal from the at least one sensor of the at least one fluid analysis monitoring system and to provide an output via a user interface positioned at a surface location based on the signal.

10. The system of claim 1, wherein each fluid analysis monitoring system comprises a flush system comprising a flush line valve and a flush line fluidly coupled to the channel, wherein the flush system is configured to provide a flush fluid to the channel to flush at least a portion of the channel.

11. The system of claim 1, wherein each fluid analysis monitoring system comprises a filter positioned between the first end of the channel and the at least one sensor, wherein the filter is configured to filter particulate matter from the fluid.

12. The system of claim 1, wherein each fluid analysis monitoring system comprises a housing configured to be coupled to the conduit, wherein the channel is formed in the housing and the at least one sensor is positioned within the housing.

13. The system of claim 1, comprising a first isolation assembly positioned between the first end of the channel and the at least one sensor and a second isolation assembly positioned between the at least one sensor and the second end of the channel.

14. The system of claim 13, wherein the first isolation assembly and the second isolation each comprise a primary valve and a secondary valve.

15. A system configured to monitor a fluid within a conduit of a drilling system or a production system, comprising:

a channel configured to extend from a side wall of the conduit;

a first isolation assembly and a second isolation assembly positioned along the channel;

a first sensor positioned along the channel between the first and second isolation assemblies and configured to generate a first signal indicative of a first characteristic of the fluid;

a second sensor positioned along the channel between the first and second isolation assemblies and configured to generate a second signal indicative of a second characteristic of the fluid, the second characteristic being different from the first characteristic;

a pump positioned along the channel and configured to adjust a flow rate of the fluid through the channel; and a controller configured to control the pump to adjust the flow rate to a first flow rate and to control the first sensor to generate the first signal while the fluid flows through the channel at the first flow rate, and wherein the controller is configured to control the pump to adjust the flow rate to a second flow rate, different than the first flow rate, and to control the second sensor to generate the second signal while the fluid flows through the channel at the second flow rate.

16. The system of claim 15, wherein the channel comprises a first end configured to extend from a first portion of the side wall of the conduit to enable flow of the fluid from the conduit into the channel and a second end configured to extend from a second portion of the side wall of the conduit to enable return of the fluid from the channel into the conduit.

17. The system of claim 15, wherein the pump is positioned downstream of the first sensor, the second sensor, or both.

18. A method of monitoring a fluid within a conduit of a drilling system or a production system, comprising:

adjusting a first valve to enable the fluid to flow from the conduit into a channel via a first end of the channel;

operating a pump to adjust a flow rate of the fluid through the channel to a first flow rate and to a second flow rate;

activating a first sensor to monitor a first characteristic of the fluid while the fluid is within the channel and based on the first flow rate of the fluid through the channel;

activating a second sensor to monitor a second characteristic of the fluid while the fluid is within the channel and based on the second flow rate of the fluid through the channel wherein the second characteristic is different from the first characteristic; and flowing the fluid back into the conduit via a second end of the channel, wherein all of the fluid that flows from the conduit into the channel via the first end of the channel flows by the first sensor and the second sensor and flows back into the conduit via the second end of the channel.

19. The method of claim 18, comprising monitoring the fluid within the channel while drilling equipment is positioned within the conduit during drilling operations.

* * * * *